US012345038B2

(12) United States Patent
Pickering et al.

(10) Patent No.: US 12,345,038 B2
(45) Date of Patent: Jul. 1, 2025

(54) INNOVATION IN MODULAR STRUCTURES

(71) Applicants: Kelly Wayne Pickering, Edgewater, CO (US); William Walter Finch, Greenwood Village, CO (US)

(72) Inventors: Kelly Wayne Pickering, Edgewater, CO (US); William Walter Finch, Greenwood Village, CO (US)

( * ) Notice: Subject to any disclaimer, the term of this patent is extended or adjusted under 35 U.S.C. 154(b) by 281 days.

(21) Appl. No.: 17/982,214

(22) Filed: Nov. 7, 2022

(65) Prior Publication Data

US 2023/0147866 A1 May 11, 2023

Related U.S. Application Data

(60) Provisional application No. 63/276,837, filed on Nov. 8, 2021.

(51) Int. Cl.
*E04B 1/34* (2006.01)
*E04B 1/348* (2006.01)

(52) U.S. Cl.
CPC ..... *E04B 1/34861* (2013.01)

(58) Field of Classification Search
CPC .. E04B 1/34861; E04B 1/34326; E04B 2/707; E04B 2/7457; E04B 7/022;
(Continued)

(56) References Cited

U.S. PATENT DOCUMENTS 3,146,497 A * 9/1964 Short ..... A63H 33/044 52/234
3,245,183 A * 4/1966 Tessin, II ..... E04H 1/005 52/282.5
(Continued)

FOREIGN PATENT DOCUMENTS

EP 0320745 A1 6/1989

OTHER PUBLICATIONS

Griffiths, Alyn ; "Open Architecture develops reconfigurable construction system of tessellating hexagons"; Nov. 16, 2005.

*Primary Examiner* — Patrick J Maestri
(74) *Attorney, Agent, or Firm* — Stanley J. Gradisar Attorney At Law, LLC; Stanley J. Gradisar

(57) ABSTRACT

A fast, flexible, and affordable structural building solution is disclosed. Current construction methodologies are prohibitively costly, slow, and wasteful. This construction method provides responsive and adaptive short to long term structural solutions. A reconfigurable flat packed modular structure can be shipped, assembled, and move-in ready in a fraction of the time of standard structural solutions. This system is easy to assemble and reusable with decreased maintenance costs and utilizes standardized shipping infrastructure. The structural elements are designed to build flexible residential, commercial, and industrial spaces. Component standardization reduces construction and maintenance cost over traditional building methods. The ease of construction reduces the learning curve for the assembly process. Embedded utilities in the components further minimize construction time. The modular nature of the design system allows for rapid assembly, disassembly, and redeployment as needed. Components are specifically built to ship using standard shipping containers for optimal organization of components and transportation.

18 Claims, 42 Drawing Sheets

(58) Field of Classification Search
CPC ..... E04B 2001/5856; E04B 2002/747; E04B 1/5831; E04C 3/06; E06B 1/02
See application file for complete search history.

(56) References Cited

U.S. PATENT DOCUMENTS

| | | | | |
|---|---|---|---|---|
| 3,312,024 | A | 4/1967 | Paschmann | |
| 3,703,058 | A | 11/1972 | Klett | |
| 4,271,654 | A | 6/1981 | Jungbluth | |
| 4,780,018 | A | 10/1988 | Godden | |
| 5,119,613 | A | 6/1992 | Atkinson | |
| 6,457,281 | B1 * | 10/2002 | Teron | E04B 1/34861 52/745.1 |
| 8,621,818 | B1 | 1/2014 | Glenn | |
| 10,458,114 | B2 | 10/2019 | Lestini | |
| 2005/0188632 | A1 | 9/2005 | Rosen | |
| 2019/0178276 | A1 | 6/2019 | Hansen | |

* cited by examiner

INNOVATION IN MODULAR STRUCTURES

CROSS-REFERENCES TO RELATED APPLICATIONS

This application claims the benefit of U.S. Provisional Application Ser. No. 63/276,837 filed on Nov. 8, 2021 and titled "Innovation In Modular Structures" which is incorporated herein by reference in its entirety for all that is taught and disclosed therein.

FIELD OF THE INVENTION

This invention relates to the field of modular construction of various habitable structures. More specifically, this invention pertains to a system of components that allows for the construction of a variety of configurations, allows rapid assembly, and easy disassembly.

BACKGROUND OF THE INVENTION

Current methods employed on modern construction sites generate high amounts of waste at a substantial cost. Nearly all structures are static in the sense that they are difficult to renovate and impossible to disassemble and reassemble. This invention would provide a residential and disaster relief solution with a higher level of sustainability and accessibility for the average consumer.

Through the application of emerging advanced manufacturing techniques and identified gaps in the market, the concept for a component-based construction system was developed. These predefined modular components with embedded utilities can be configured based on the end-user's needs, reconfigured, added to, scaled down, disassembled, and moved as the structure's owner and/or tenant's needs change throughout the years.

SUMMARY OF THE INVENTION

A modular system of elements used to construct reconfigurable habitable structural solutions is disclosed. Core elements of the solution can be assembled into larger components which are used to construct a final assembly. Each element is designed according to a standardized 1×1×1 repeatable grid. This x-y-z axis grid establishes the base measurement that will allow the design system to scale on three axes. The base of this grid system can be measured in either feet or inches depending on the specific element and component. This repeatable grid system allows the structural components to be assembled, disassembled, and reconfigured based on the occupant's structural layout requirements.

Figure 1A:
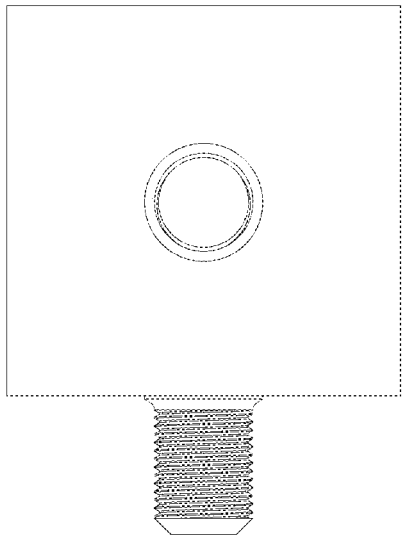
FIGS. 1A, 1B, and 1C show several views of a flat cam that is used to connect larger components in an embodiment of the present invention.

To assist in the understanding of the present disclosure the following list of components and associated numbering found in the drawings is provided herein:

Table of Components.

| Component | # |
|---|---|
| bolt | 1 |
| six-axis cube | 2 |
| threaded insert | 3 |
| flat cam | 4 |
| long beam | 6 |
| long beam no utilities | 8 |
| short beam | 10 |
| vertical wall support | 12 |
| long horizontal wall support | 14 |
| short vertical wall support | 15 |
| short horizontal wall support | 16 |
| short vertical door window support | 17 |
| full floor or roof assembly | 18 |
| embedded utilities | 19 |
| half floor or roof assembly | 20 |
| full wall assembly | 22 |

-continued

Table of Components.

| Component | # |
|---|---|
| half wall assembly | 24 |
| door assembly | 25 |
| roof riser assembly | 26 |
| window riser assembly | 28 |
| sloped roof | 29 |
| single pod assembly | 30 |
| modified pod assembly | 32 |
| square floor panel | 34 |
| rectangular floor panel | 36 |
| solid wall panel | 38 |
| wall panel window | 40 |
| wall panel large window | 42 |
| wall panel door | 44 |
| wall panel wide door | 46 |
| wall panel column | 48 |
| square ceiling panel | 50 |
| rectangular ceiling panel | 52 |
| rectangular ceiling panel with opening | 54 |
| floor panel border 2x | 56 |
| floor panel border 1/2x | 58 |
| floor panel border 1x | 60 |
| rectangular small roof panel | 62 |
| rectangular large roof panel | 64 |
| ceiling panel border 2x | 66 |
| ceiling panel border 1/2x | 68 |
| ceiling panel border 1x | 70 |
| attic end triangle base | 72 |
| attic end rectangle base | 74 |
| attic end triangle | 76 |
| attic end rectangle | 78 |
| attic side rectangle base | 80 |
| attic side rectangle | 82 |
| attic side spacer base | 84 |
| attic side spacer | 86 |
| roof rafter parallelogram | 88 |
| roof ridge rectangle | 90 |
| attic column | 92 |
| rectangular point grid | 94 |
| floor plan | 96 |
| floor subassembly | 98 |
| floor border subassembly | 100 |
| parallel wall assembly | 102 |
| perpendicular wall assembly | 104 |
| "T" wall assembly | 106 |
| plus wall assembly | 108 |
| three-bedroom dwelling | 110 |
| ceiling subassembly | 112 |
| base level assembly | 114 |
| base level attic components assemblage | 116 |
| all attic components assemblage | 118 |
| roof truss assembly | 120 |
| roof assemblage | 122 |
| roof assembly | 126 |
| final assemblage | 128 |
| wall assembly composition | 130 |
| wall thickness | 132 |
| floor panel borders assembly | 134 |

DETAILED DESCRIPTION

Figure 1B:
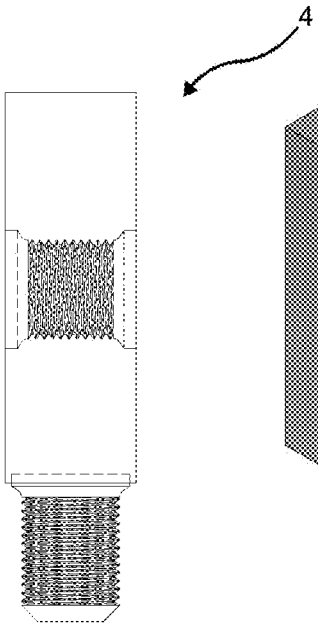
Figure 1C:
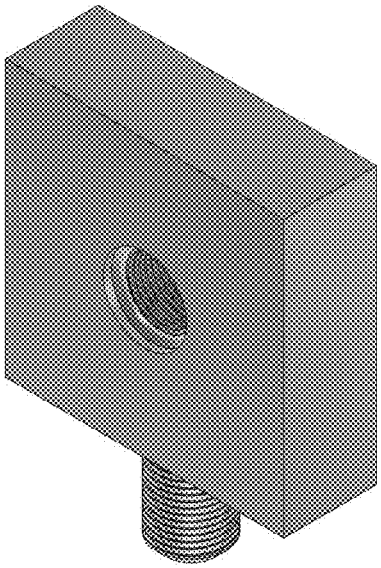
Figure 2A:
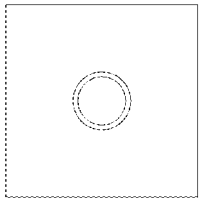
FIGS. 2A, 2B, 2C, and 2D show several views of a six-axis cube that is used to connect larger components in an embodiment of the present invention.
Figure 2B:
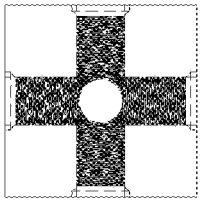
Figure 2C:
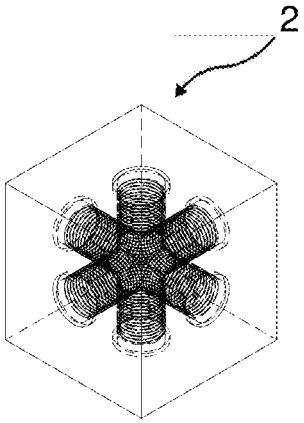
Figure 2D:
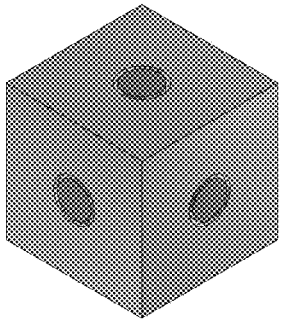
Figures 3A, 3B, 3C, 3D:
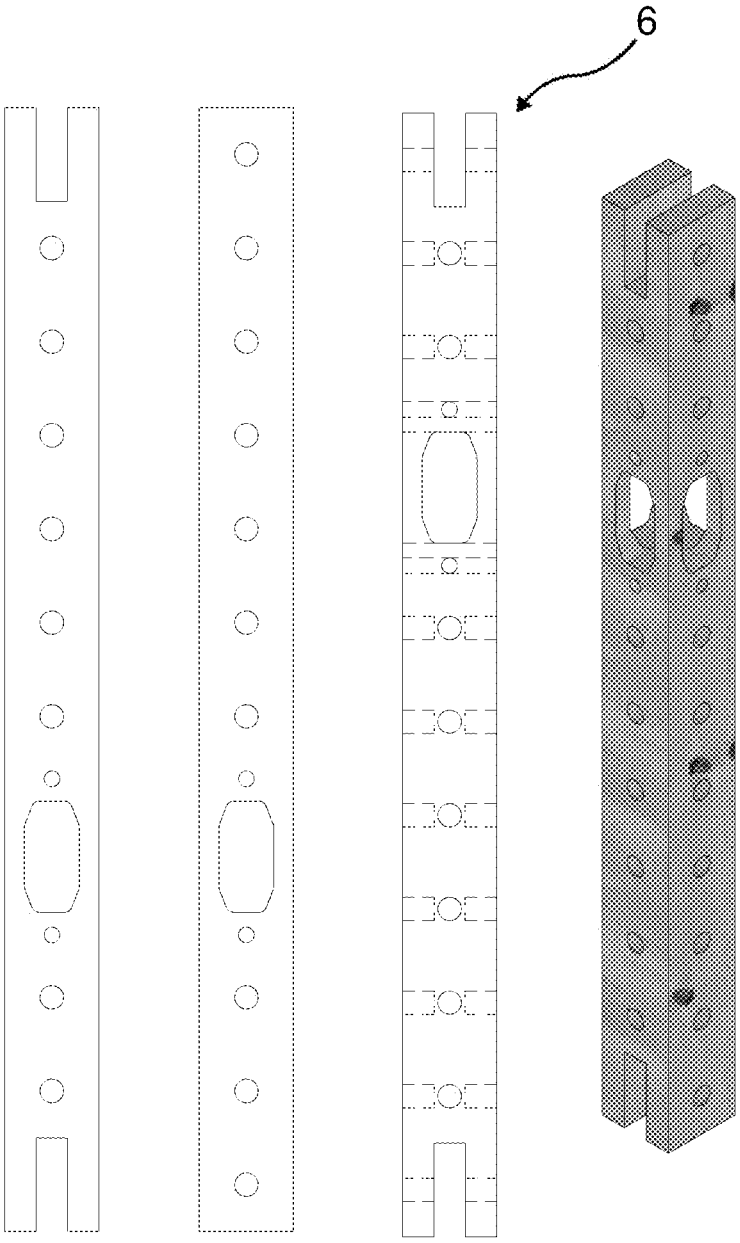
FIGS. 3A, 3B, 3C, and 3D show several views of a long beam that is used as a structural element of larger components in an embodiment of the present invention.
Figures 4A, 4B, 4C, 4D:
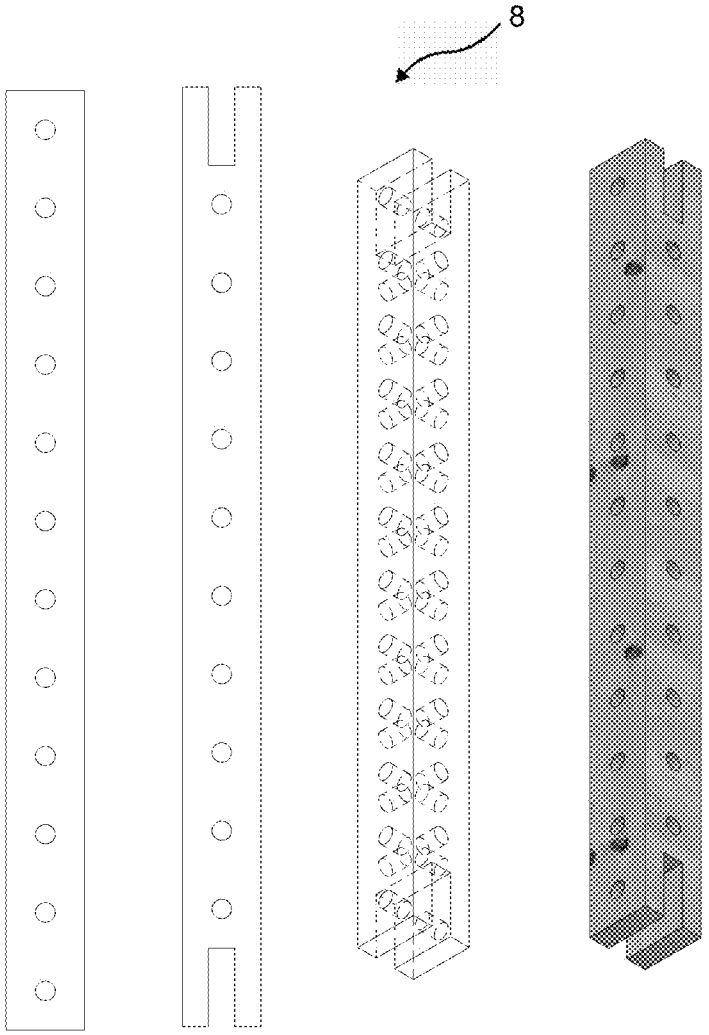
FIGS. 4A, 4B, 4C, and 4D show several views of a long beam no utilities that is used as a structural element of larger components in an embodiment of the present invention.
Figures 5A, 5B, 5C, 5D:
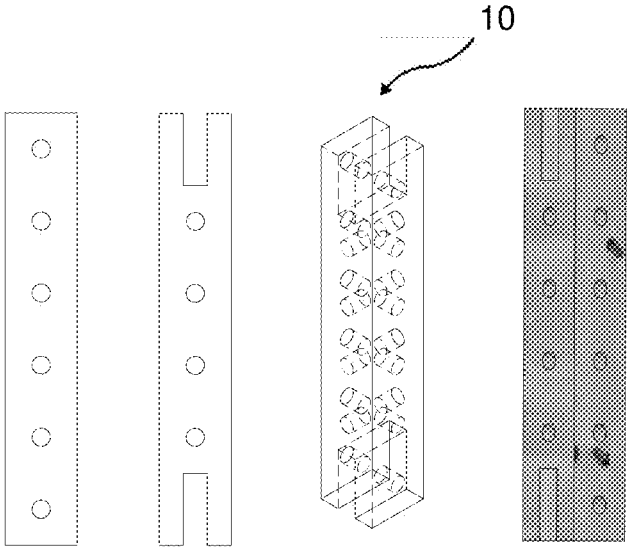
FIGS. 5A, 5B, 5C, and 5D show several views of a short beam that is used as a structural element of larger components in an embodiment of the present invention.
Figures 6A, 6B, 6C, 6D:
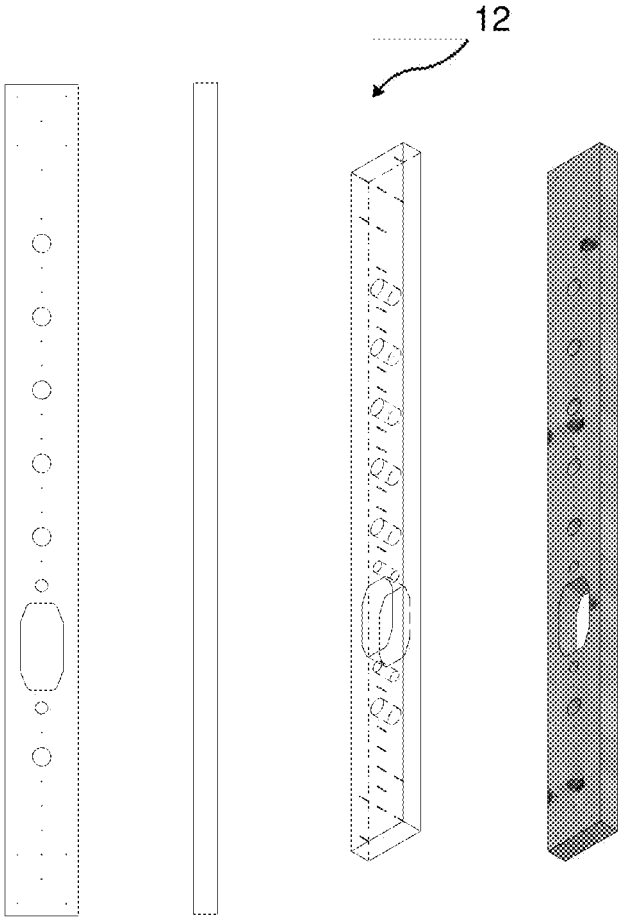
FIGS. 6A, 6B, 6C, and 6D show several views of a vertical wall support that is used as a structural element of larger components in an embodiment of the present invention.

Referring now to the Figures, in which like reference numerals refer to structurally and/or functionally similar elements thereof, FIGS. 1A, 1B, and 1C show several views of a flat cam 4 that is used to connect larger components in an embodiment of the present invention. Referring now to FIGS. 1A, 1B, and 1C, the flat cam 4 is utilized to connect the bolt 1, threaded insert 3, long beam 6, long beam no utilities 8, and short beam 10 to six axis cube 2.

FIGS. 2A, 2B, 2C, and 2D show several views of a six-axis cube that is used to connect larger components in an embodiment of the present invention. Referring now to FIGS. 2A, 2B, 2C, and 2D, the six-axis cube 2 is utilized to connect the bolt 1, threaded insert 3, long beam 6, long beam no utilities 8, and short beam 10 through the attachment of the flat cam 4.

FIGS. 3A, 3B, 3C, and 3D show several views of a long beam that is used to connect larger components in an embodiment of the present invention. Referring now to FIGS. 3A, 3B, 3C, and 3D, the long beam 6 is utilized to connect the bolt 1, threaded insert 3, long beam no utilities 8 and short beam 10 through the attachment of the flat cam 4 and six axis cube 2.

FIGS. 4A, 4B, 4C, and 4D show several views of a long beam no utilities that is used to connect larger components in an embodiment of the present invention. Referring now to FIGS. 4A, 4B, 4C, and 4D, the long beam no utility 8 is utilized to connect the bolt 1, threaded insert 3, long beam 6 and short beam 10 through the attachment of the flat cam 4 and six axis cube 2.

FIGS. 5A, 5B, 5C, and 5D show several views of a short beam that is used to connect larger components in an embodiment of the present invention. Referring now to FIGS. 5A, 5B, 5C, and 5D, the short beam 10 is utilized to connect the long beam 6 through the attachment of the flat cam 4 and six axis cube 2.

FIGS. 6A, 6B, 6C, and 6D show several views of a vertical wall support that is used to connect larger components in an embodiment of the present invention. Referring now to FIGS. 6A, 6B, 6C, and 6D, the vertical wall support 12 is utilized to connect the long horizontal wall support 14 and short horizontal wall support 16.

Figures 7A, 7B:
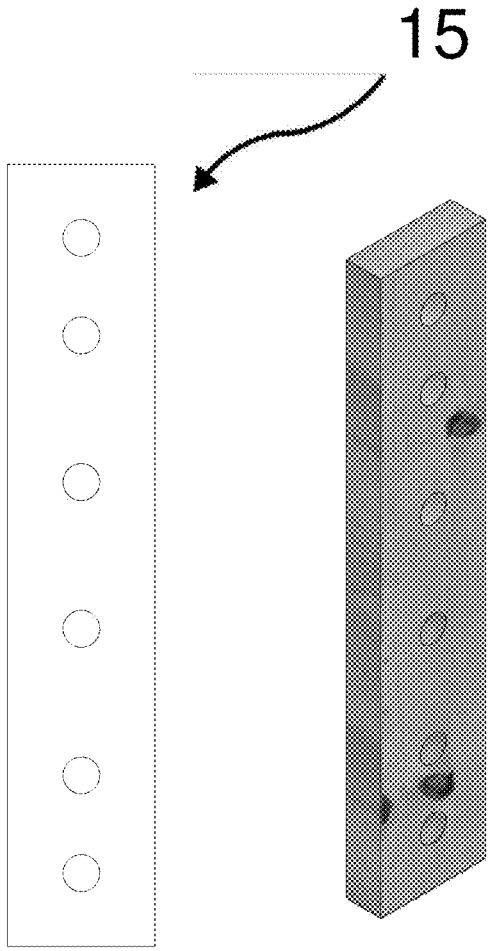
FIGS. 7A and 7B show several views of a short vertical wall support that is used as a structural element of larger components in an embodiment of the present invention.
Figures 8A, 8B, 8C, 8D:
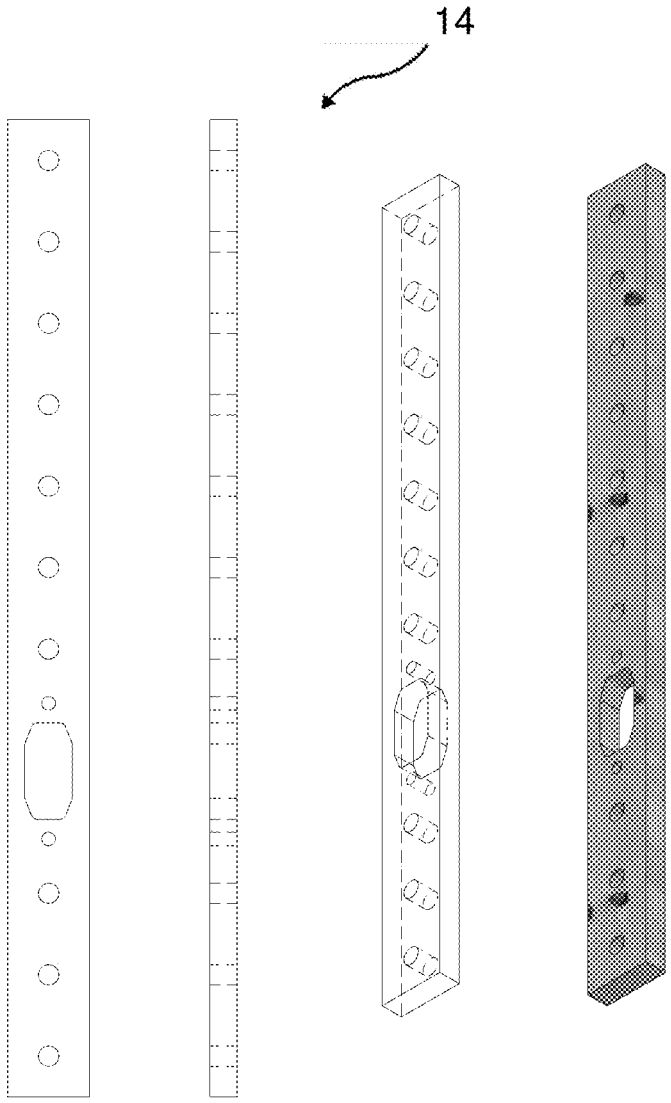
FIGS. 8A, 8B, 8C, and 8D show several views of a long horizontal wall support that is used as a structural element of larger components in an embodiment of the present invention.

FIGS. 7A, and 7B show several views of a short vertical wall support that is used to connect larger components in an embodiment of the present invention. Referring now to FIGS. 7A, and 7B, the short vertical wall support 15 is utilized to connect the short horizontal wall support 16.

FIGS. 8A, 8B, 8C, and 8D show several views of a long horizontal wall support that is used to connect larger components in an embodiment of the present invention. Referring now to FIGS. 8A, 8B, 8C, and 8D, the long horizontal wall support 14 is utilized to connect the vertical wall support 12.

Figures 9A, 9B:
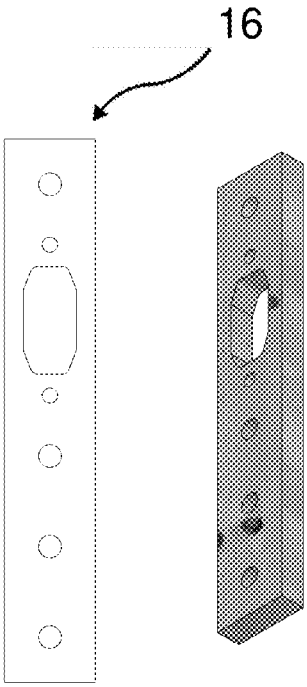
FIGS. 9A and 9B show several views of a short horizontal wall support that is used as a structural element of larger components in an embodiment of the present invention.

FIGS. 9A, and 9B show several views of a short horizontal wall support that is used to connect larger components in an embodiment of the present invention. Referring now to FIGS. 9A, and 9B, the short horizontal wall support 16 is utilized to connect the vertical wall support 12 and short vertical wall support 15.

Figure 10:
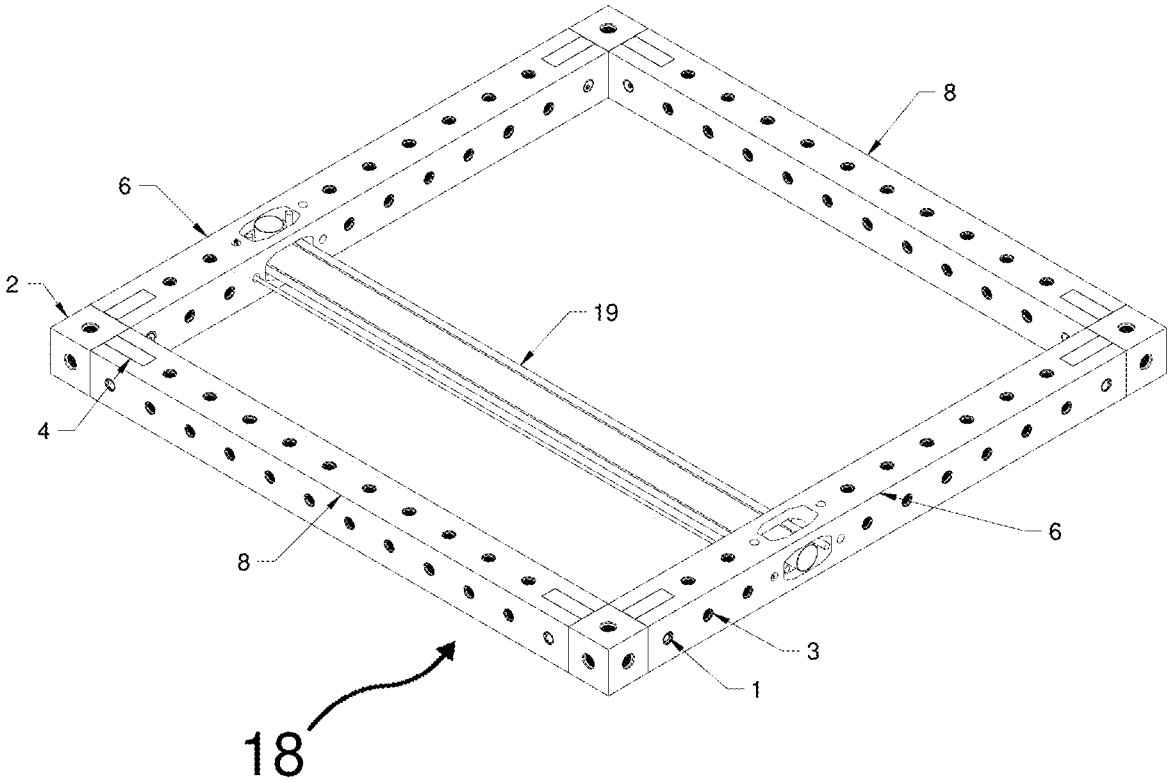
FIG. 10 shows a single view of a full floor or roof assembly 18 which utilizes the unique elements of bolt 1, six axis cube 2, threaded insert 3, flat cam 4, long beam 6, embedded utilities 19, and long beam no utilities 8 in an embodiment of the present invention.

FIG. 10 shows a full floor or roof assembly 18 that is used to connect larger components in an embodiment of the present invention. Referring now to FIG. 10, full floor, or roof assembly 18 is utilized to connect half floor or roof assembly 20, full wall assembly 22, and half wall assembly 24. Also shown in FIG. 10 are embedding utilities 19 into an assembled full floor or roof assembly 18. Embedded utilities 19 may include, but are not limited to, water supply lines, wastewater return lines, electrical lines, cable tv lines, security lines, gas lines, oil lines, fire suppression lines, climate controls, and home security.

Figure 11:
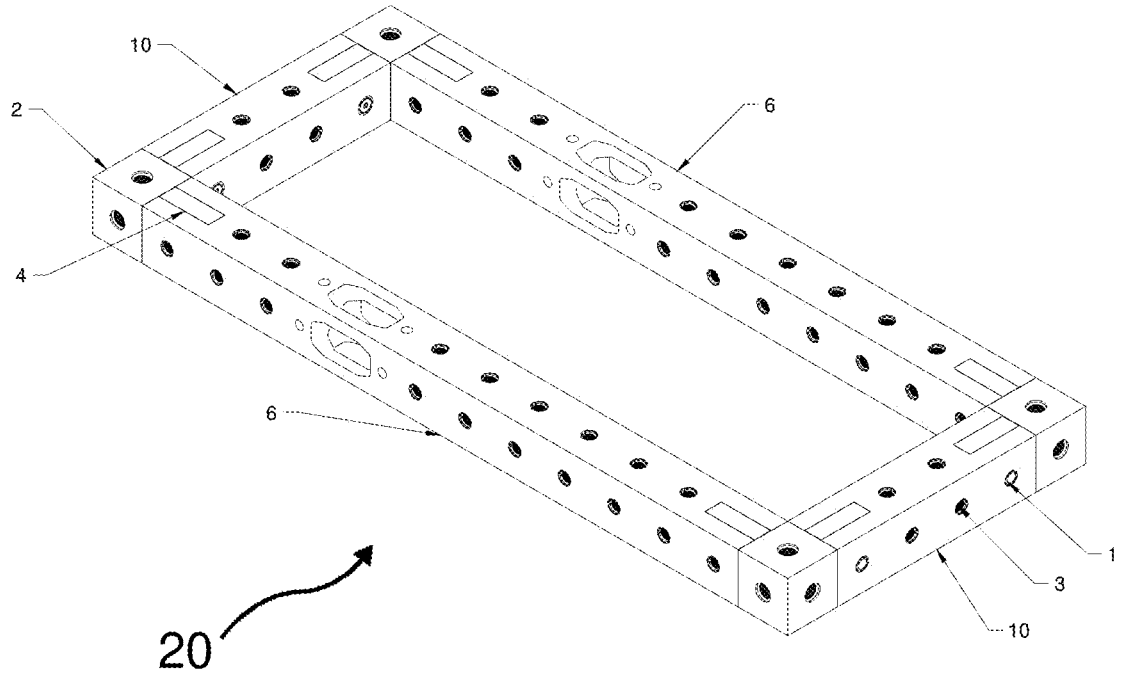
FIG. 11 shows a single view of a half floor or roof assembly 20 which utilizes the unique elements of bolt 1, six axis cube 2, threaded insert 3, flat cam 4, long beam 6, and short beam 10 in an embodiment of the present invention.

FIG. 11 shows a half floor or roof assembly 20 that is used to connect larger components in an embodiment of the present invention. Referring now to FIG. 11, half floor or roof assembly 20 is utilized to connect full floor or roof assembly 18, half floor or roof assembly 20, full wall assembly 22, and half wall assembly 24.

Figure 12:
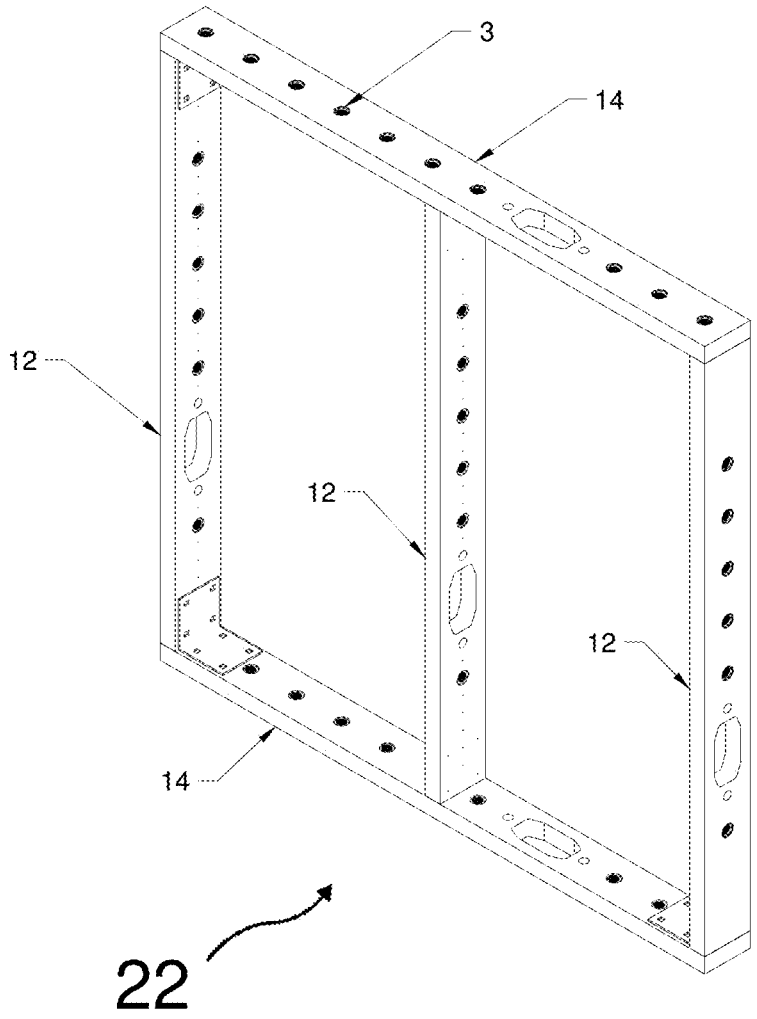
FIG. 12 shows a single view of a full wall assembly 22 which utilizes the unique elements of threaded insert 3, vertical wall support 12 and long horizontal wall support 14 in an embodiment of the present invention.

FIG. 12 shows a full wall assembly 22 that is used to connect larger components in an embodiment of the present invention. Referring now to FIG. 12, full wall assembly 22 is utilized to connect full floor or roof assembly 18, half floor or roof assembly 20, and half wall assembly 24.

Figure 13:
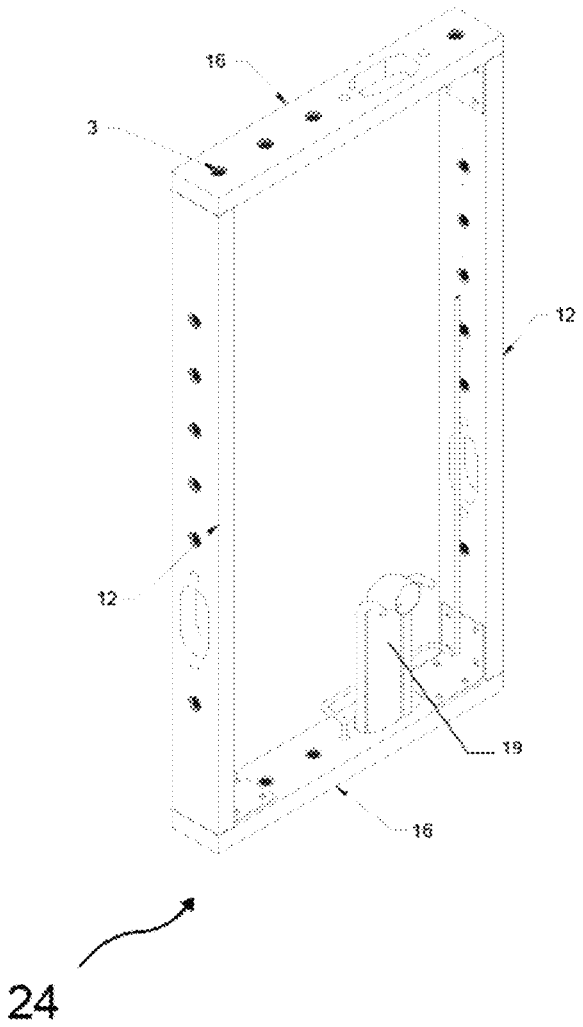
FIG. 13 shows a single view of a half wall assembly 24 which utilizes the unique elements of threaded insert 3, vertical wall support 12 and short horizontal wall support 16 in an embodiment of the present invention.

FIG. 13 shows a half wall assembly 24 that is used to connect larger components in an embodiment of the present invention. Referring now to FIG. 13, half wall assembly 24 is utilized to connect full floor or roof assembly 18, half floor or roof assembly 20, and full wall assembly 22. Also shown in FIG. 13 are embedding utilities 19 into an assembled half wall assembly 24. Embedded utilities 19 may include, but are not limited to, water supply lines, wastewater return lines, electrical lines, cable tv lines, and security lines, gas, oil, fire suppression, climate controls, and home security.

Figure 14A:
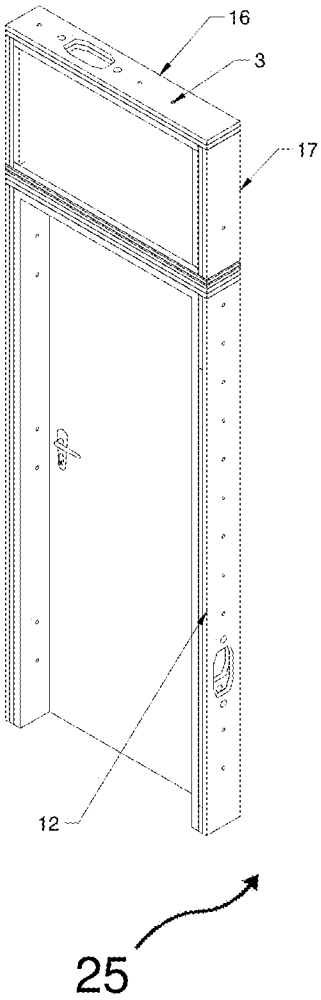
FIGS. 14A and 14B show several views of a door assembly 25 which utilizes the unique elements of threaded insert 3, vertical wall support 12, and short horizontal wall support 16 in an embodiment of the present invention.
Figure 14B:
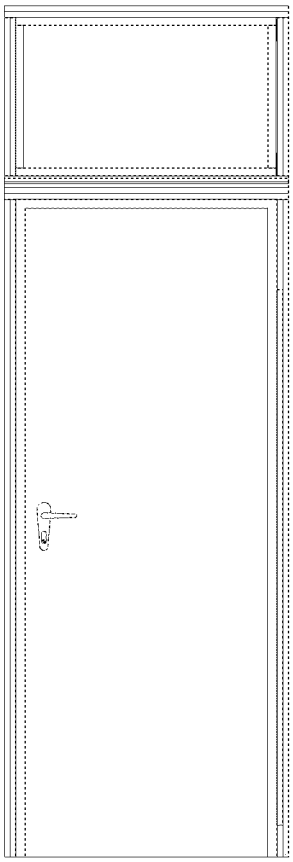

FIGS. 14A and 14B shows a door assembly 25 that is used to connect larger components in an embodiment of the present invention. Referring now to FIGS. 14A and 14B, door assembly 25 is utilized to connect full floor or roof assembly 18, half floor or roof assembly 20, short horizontal wall support 16, and full wall assembly 22.

Figure 15:
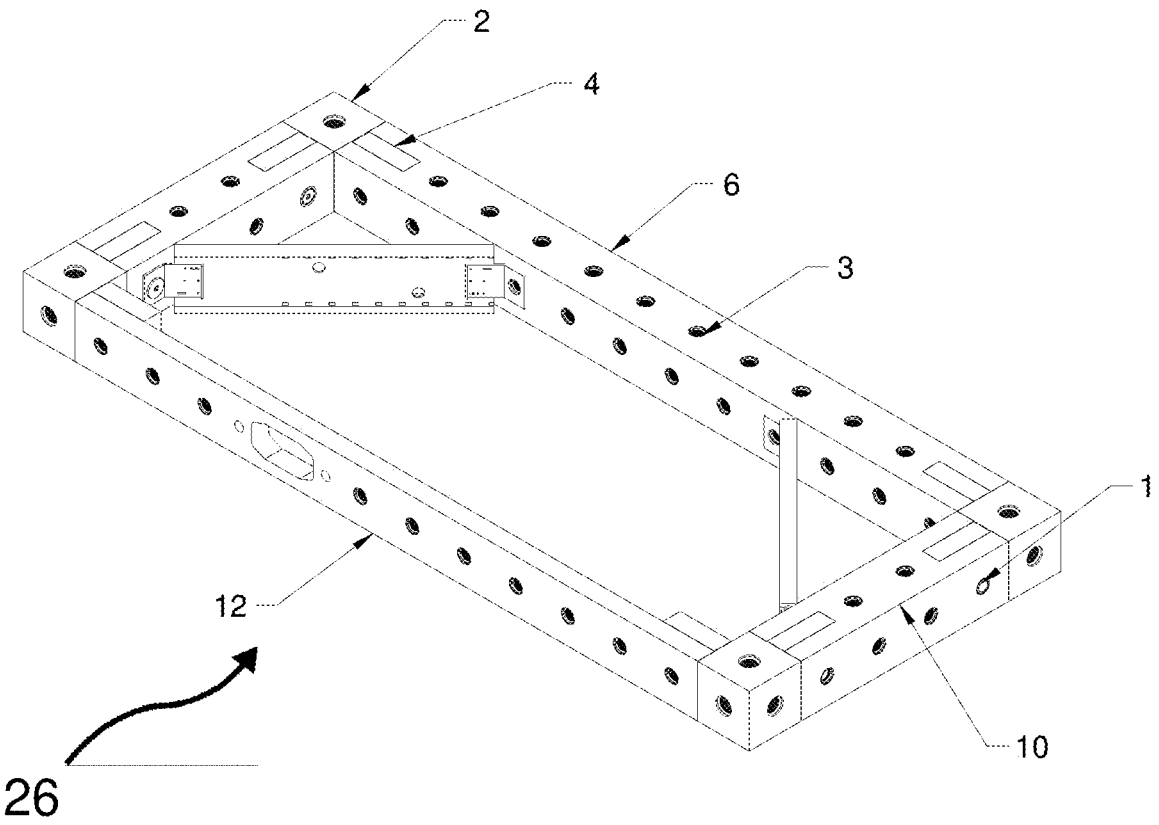
FIG. 15 shows a roof riser assembly 26 which utilizes the unique elements of bolt 1, six axis cube 2, threaded insert 3, flat cam 4, long beam 6, short beam 10, and long horizontal wall support 14 in an embodiment of the present invention.

FIG. 15 shows a roof riser 26 that is used to connect larger components in an embodiment of the present invention. Referring now to FIG. 15, roof riser assembly 26 is utilized to connect full floor or roof assembly 18, half floor or roof assembly 20, full wall assembly 22 and half wall assembly 24.

Figure 16A:
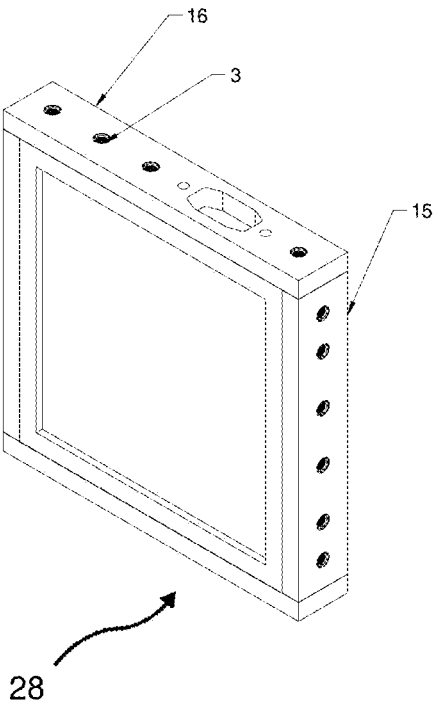
FIGS. 16A and 16B show several views of a window riser assembly 28 which utilizes the unique elements of threaded insert 3, short vertical wall support 15, short horizontal wall support 16 in an embodiment of the present invention.
Figure 16B:
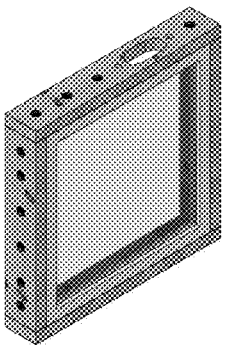

FIGS. 16A and 16B shows a window riser 28 that is used to connect larger components in an embodiment of the present invention. Referring now to FIGS. 16A and 16B, window riser assembly 28 is utilized to connect full floor or roof assembly 18, half floor or roof assembly 20, full wall assembly 22 and half wall assembly 24.

Figure 17:
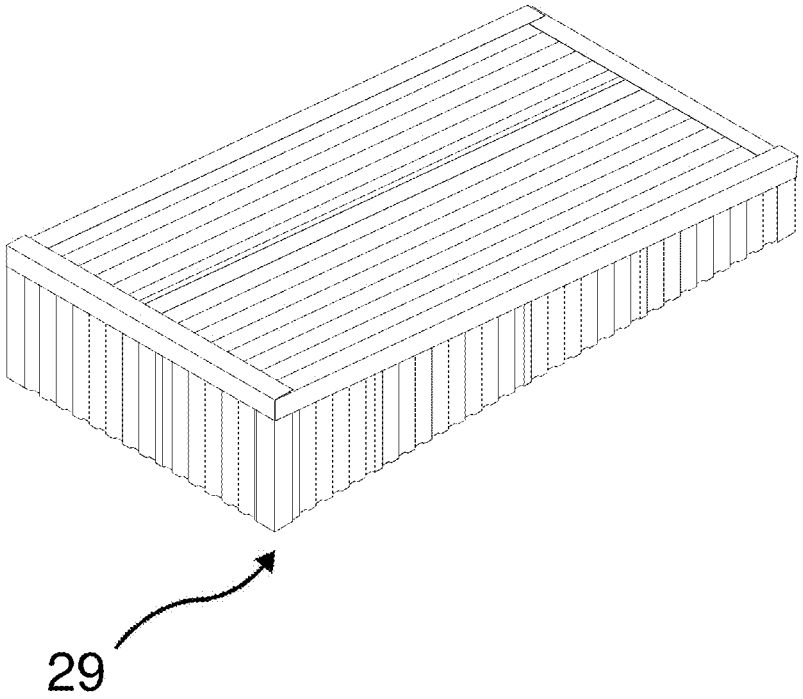
FIG. 17 shows a sloped roof 29 that is used to connect larger components in an embodiment of the present invention.

FIG. 17 shows a sloped roof 29 that is used to connect larger components in an embodiment of the present invention. Referring now to FIG. 17, sloped roof 29 is utilized to cover full floor or roof assembly 18, half floor or roof assembly 20.

Figure 18:
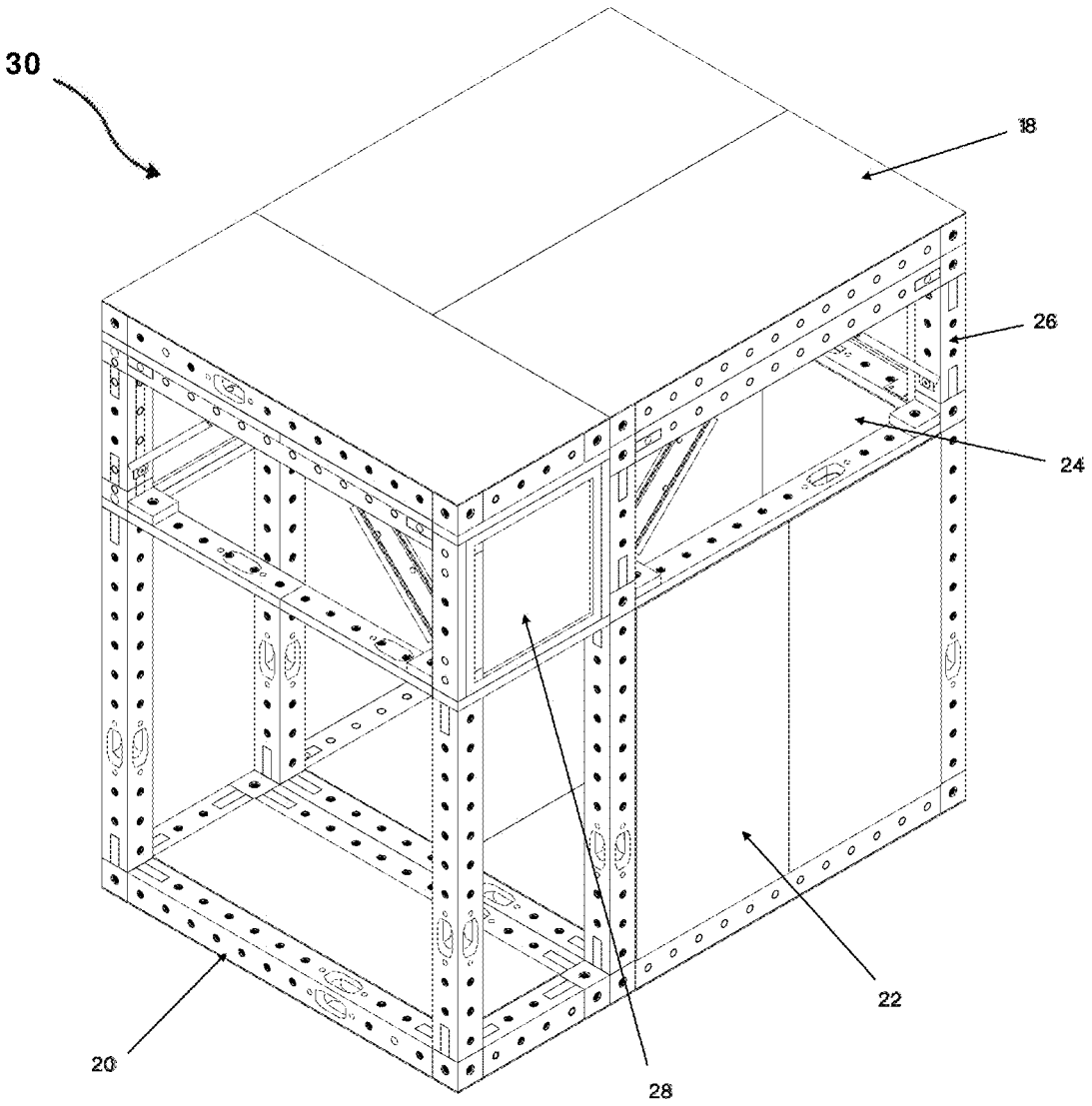
FIG. 18 shows a single pod assembly 30 which utilizes the unique elements of full floor or roof assembly 18, half floor or roof assembly 20, full wall assembly 22, half wall assembly 24, roof riser assembly 26, and window riser assembly 28 in an embodiment of the present invention.

FIG. 18 shows a single pod assembly 30 that is used to build larger structures in an embodiment of the present invention. Referring now to FIG. 18, single pod assembly 30 utilizes full floor or roof assembly 18, half floor or roof assembly 20, full wall assembly 22, half wall assembly 24, roof riser assembly 26, and window riser assembly 28.

Figure 19:
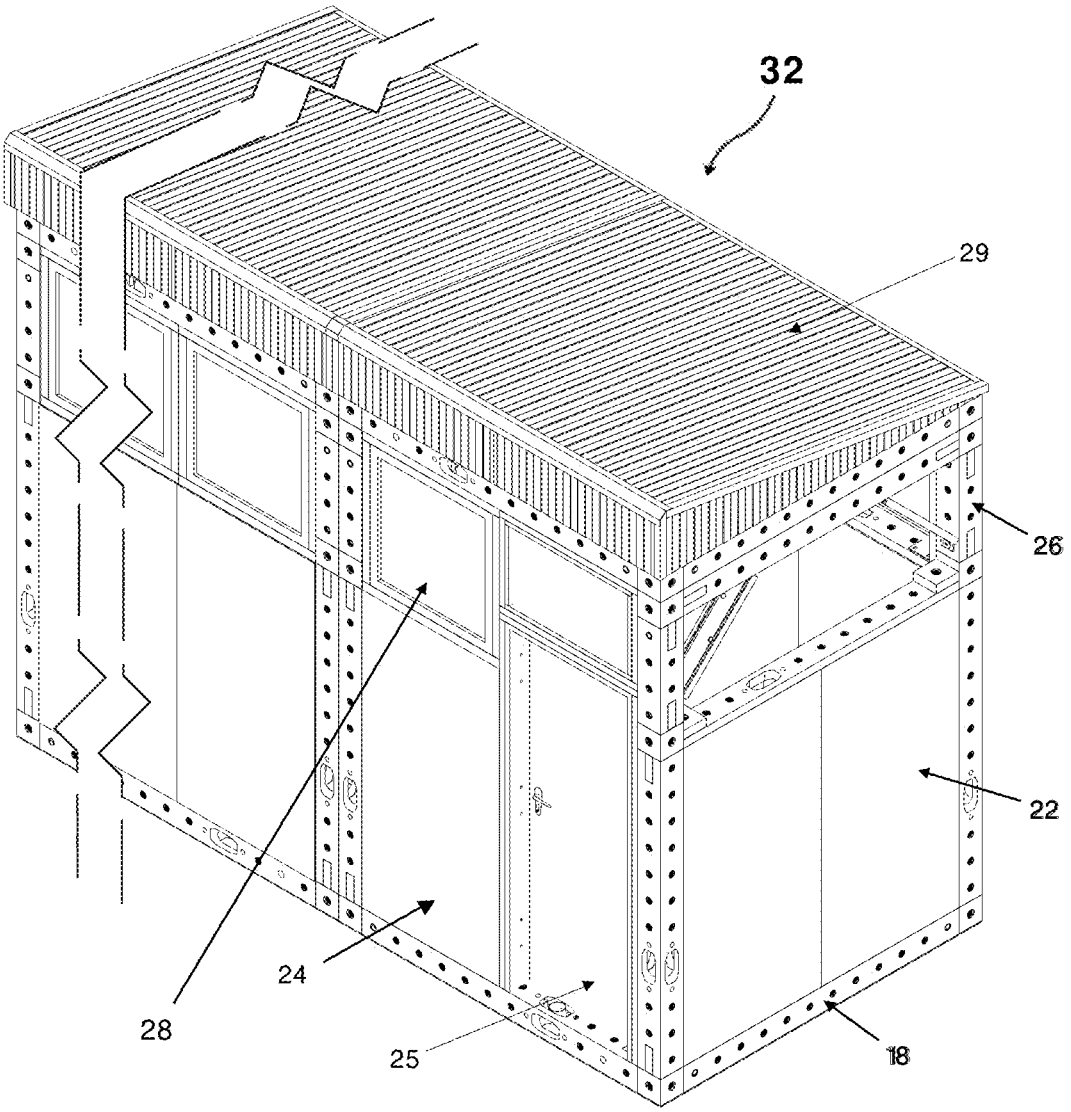
FIG. 19 shows a modified pod assembly 32 which utilizes the unique elements of full floor or roof assembly 18, full wall assembly 22, half wall assembly 24, roof riser assembly 26, door assembly 25, sloped roof 29 and window riser assembly 28 in an embodiment of the present invention.

FIG. 19 shows a modified pod assembly 32 that is used to modify structures pre and post construction in an embodiment of the present invention. Referring now to FIG. 19, modified pod assembly 32 utilizes full floor or roof assembly 18, half floor or roof assembly 20, full wall assembly 22, half wall assembly 24, door assembly 25, roof riser assembly 26, window riser assembly 28, and sloped roof 29.

Figure 20A:
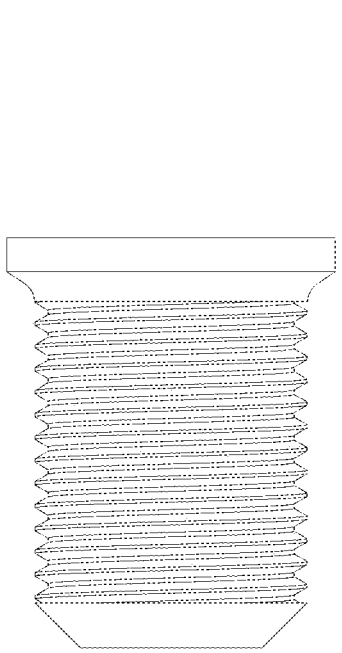
FIGS. 20A and 20B show several views of a bolt that is used to connect larger components in an embodiment of the present invention.
Figure 20B:
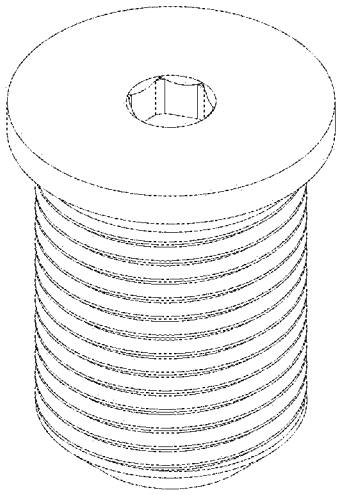

FIGS. 20A and 20B show several views of a bolt 1 that is used to connect larger components in an embodiment of the present invention. Referring now to FIGS. 20A and 20B, the bolt 1 is utilized to connect, but is not limited to, the threaded insert 3, flat cam 4, long beam 6, long beam no utilities 8, short beam 10, and six axis cubes 2.

Figure 21A:
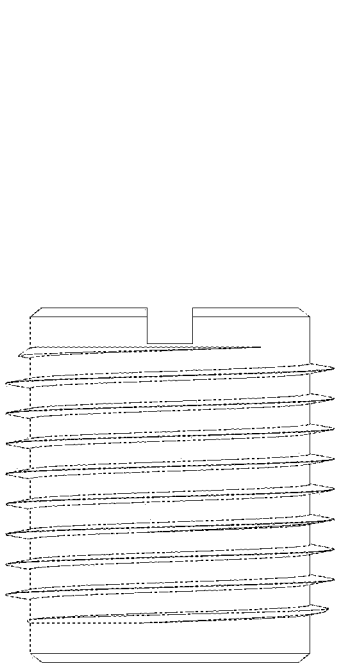
FIGS. 21A and 21B show several views of a threaded insert that is used to connect larger components in an embodiment of the present invention.
Figure 21B:
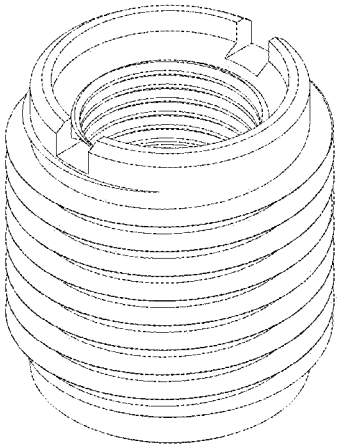

FIGS. 21A and 21B show several views of a threaded insert 3 that is used to connect larger components in an embodiment of the present invention. Referring now to FIGS. 21A and 21B, the threaded insert 3 is utilized to connect, but is not limited to, the bolt 1, flat cam 4, long beam 6, long beam no utilities 8, and short beam 10, and six axis cubes 2.

FIGS. 22A through 52 and FIGS. 55 through 70 just depict shapes and sizes of components without the detail shown in FIGS. 1 through 21B. One skilled in the art will recognize that the individual components shown in FIGS. 1 through 21B are inherently present in the components shown in FIGS. 22A through 52 and FIGS. 55 through 70.

Figures 22A, 22B, 22C:
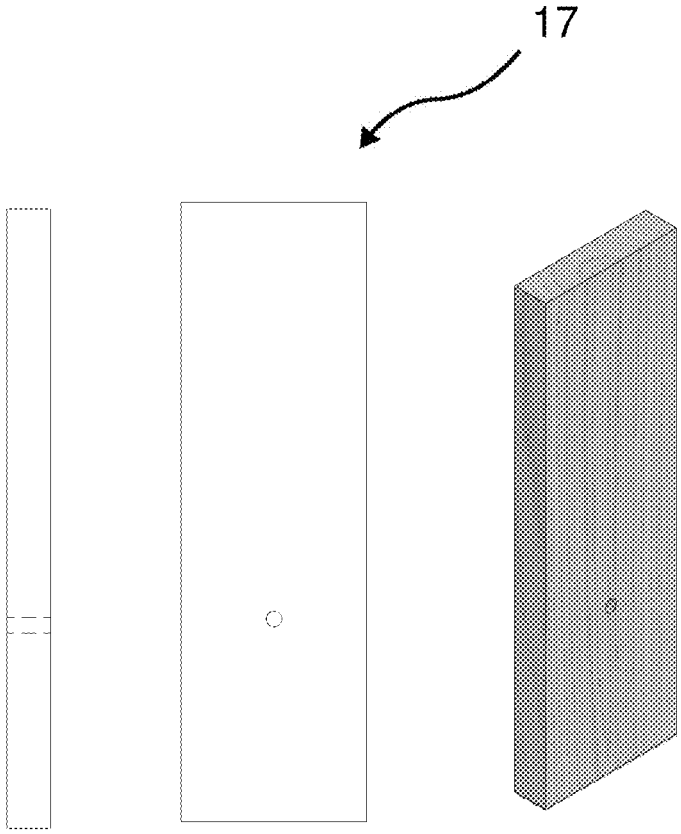
FIGS. 22A, 22B, and 22C show several views of a short vertical door window support that is used to connect larger components in an embodiment of the present invention.

FIGS. 22A, 22B, and 22C show several views of a short vertical door window support 17 that is used to connect larger components in an embodiment of the present invention. Referring now to FIGS. 22A, 22B, and 22C, the short vertical door window support 17 is utilized to connect the short horizontal wall support 16, and vertical wall support 12 (see FIG. 14).

Figure 23:
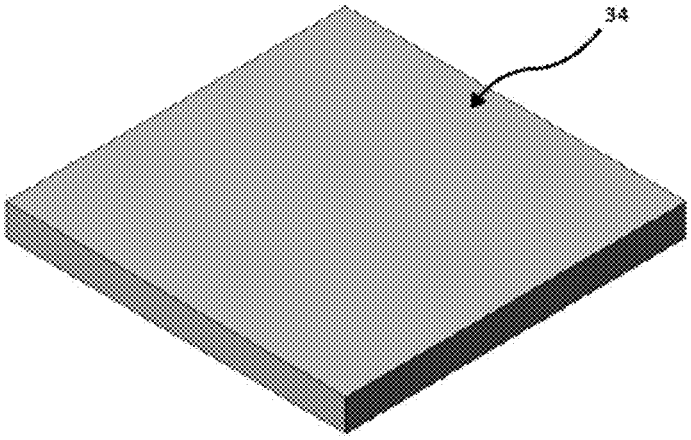
FIGS. 23 and 24 show two different sizes of floor panels in an embodiment of the present invention.
Figure 24:
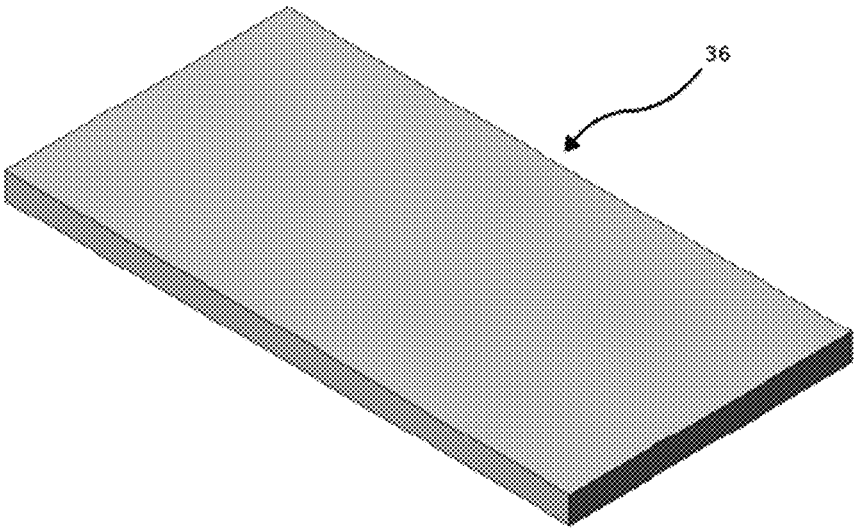

FIGS. 23 and 24 show two different sizes of floor panels. The thickness of the floor panels is arbitrary, depending on structural requirements or other considerations. In this instantiation, the floor panels are approximately 6 inches thick. The length and width of floor panels are integer multiple of the grid spacings in both directions. For this instantiation, FIG. 23 shows a square floor panel 34 with width and length of a single grid spacing. FIG. 24 shows a rectangular floor panel 36 with a width of one grid spacing and length of two grid spacings. Other instantiations of floor panels having overall dimension of other multiples of grid spacings are possible. Also, other instantiations of floor panels may have rectangular, or other shaped, openings to accommodate various architectural features such as stairs, access panels, etc.

Figure 25:
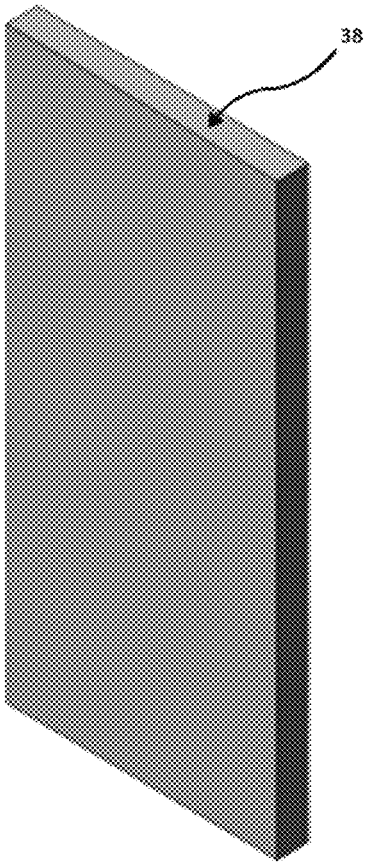
FIG. 25, shows a solid wall panel in an embodiment of the present invention.
Figure 26:
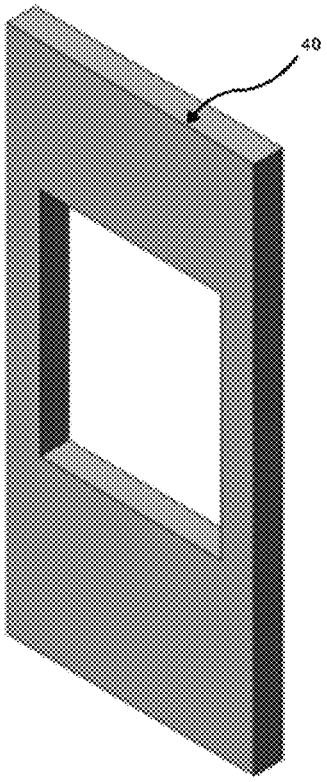
FIGS. 26 and 27 show window wall panel of different sizes in an embodiment of the present invention.
Figure 27:
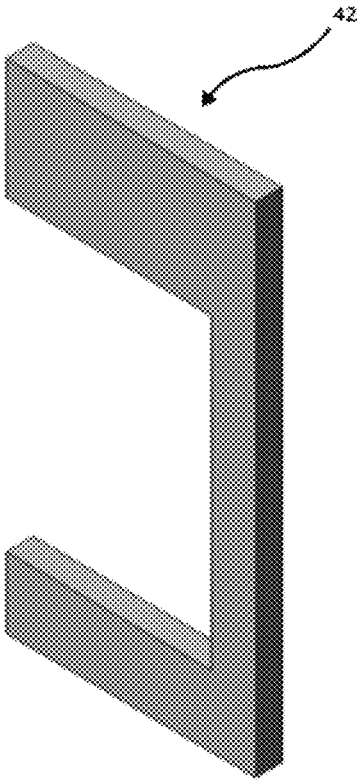

FIGS. 25, 26, and 27 show different types of wall panels, some having openings to accommodate different architectural elements, including but not limited to doors, windows, etc. The thickness and height of the wall panels is arbitrary, depending on structural requirements or other considerations. In this instantiation, all wall panels are all approximately six inches thick and the height of the walls are based on the underlying structural grid spacings, with all wall panels having identical overall dimensions. The wall panel components support the ceiling panels, roof trusses, and attic components on the top floor of a final assembly. The width of wall panels are all integer multiples of grid spacings, less the thickness of one wall panel.

FIG. 25 shows a solid wall panel 38 having no openings. The wall panel components support the ceiling panels, roof trusses, and attic components on the top floor of a final assembly. Solid wall panel 38 can accommodate a variety of walls that is not limited to plumbing walls, HVAC (mini-split) walls, light walls, kitchen and bathroom walls, and main utility walls.

FIG. 26 shows a wall panel window 40 having an opening to accept a window. Sizes of various openings are specified to accept particular windows of any type, including, but not limited to, double-hung, picture, transom, or other styles. In this instantiation, window openings are rectangular. However, other shapes (e.g., circular) may be implemented. The wall panel components support the ceiling panels, roof trusses, and attic components on the top floor of a final assembly.

FIG. 27 shows a wall panel large window 42 having an opening to accept a large window that cannot be contained within a single wall panel. The width of wall panel large windows 42 is an integer number of grid spacings, less half the thickness of the wall panels. Sizes of various openings are specified to accept particular windows of any type, including, but not limited to, picture windows, single hung, double hung, slider, casement, awning, bay, bow, garden, hopper, tilt and turn windows or other styles. In this instantiation, window openings are rectangular. However, other shapes (e.g., circular) may be implemented. In this instantiation, two identical wall panel large windows are placed with the openings facing each other, although other configurations are possible. The wall panel components support the ceiling panels, roof trusses, and attic components on the top floor of a final assembly.

Figure 28:
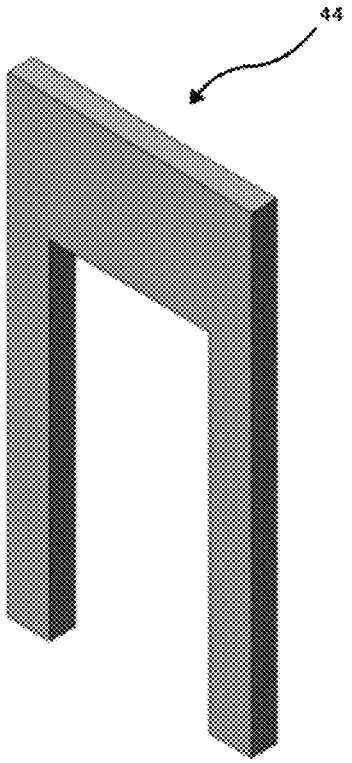
FIG. 28 shows a wall panel door in an embodiment of the present invention.

FIG. 28 shows a wall panel door 44 having an opening to accept a door and large picture window. Sizes of various openings are specified to accept doors and windows of any type, including, but not limited to, standard interior or exterior doors, french doors, slush door, glass, paneled, louver, rectangular grills, & side lights, picture windows, single hung, double hung, slider, casement, awning, bay, bow, garden, hopper, tilt and turn windows, or other styles. In this instantiation, door openings are rectangular. However, other shapes (e.g., arched top) may be implemented. The wall panel components support the ceiling panels, roof trusses, and attic components on the top floor of a final assembly.

Figure 29:
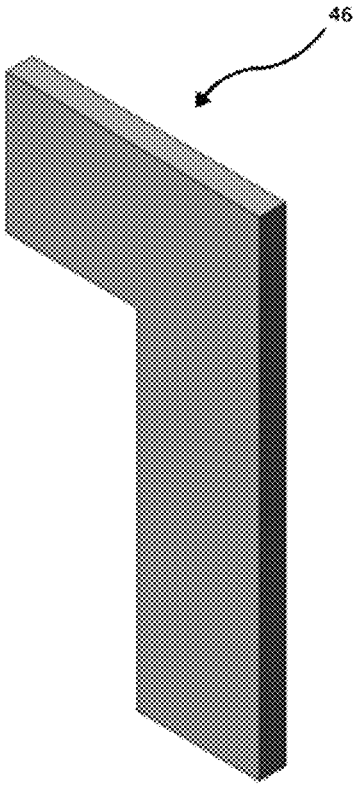
FIG. 29 shows a wall panel wide door in an embodiment of the present invention.

FIG. 29 shows a wall panel wide door 46 having an opening to accept a door where two sides of the opening are coincident with two sides of the panel. Sizes of various openings are specified to accept doors of any type, including, but not limited to, standard interior or exterior doors, french doors, slush door, glass, paneled, louver, rectangular grills, & side lights. The wall panel components support the ceiling panels, roof trusses, and attic components on the top floor of a final assembly.

Figure 30:
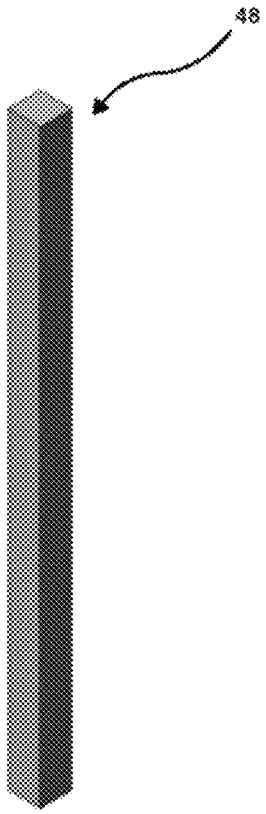
FIG. 30 shows a wall panel column in an embodiment of the present invention.

FIG. 30 shows a wall panel column 48 which connects two, three, or four wall panels. The height of wall panel columns 48 equals the height of wall panels. Wall panel columns 48 have a square cross section with a width equal to the wall panel thickness. The wall panel columns 48 are coincident with the grid points of the rectangular point grid 94. The wall panel column 48 is specified for internal or external use and can have internal and external finishes applied on any of the vertical surfaces. The wall panel components support the ceiling panels, roof trusses, and attic components on the top floor of a final assembly.

Figure 31:
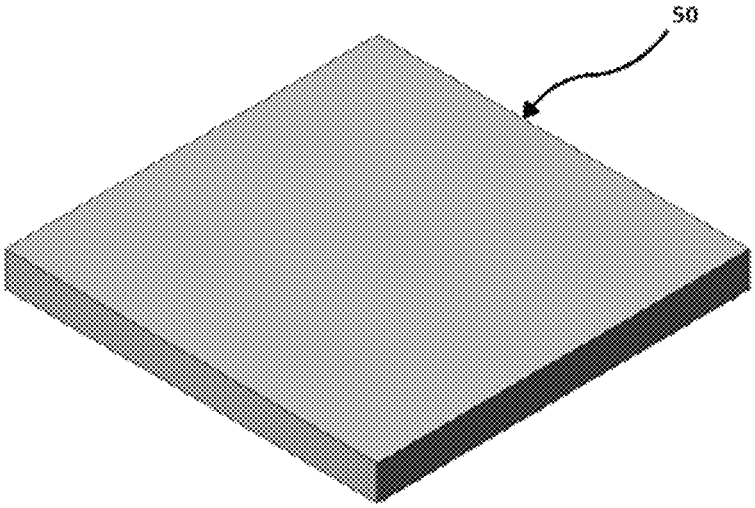
FIGS. 31, 32, and 33 show three different sizes of ceiling panels in an embodiment of the present invention.
Figure 32:
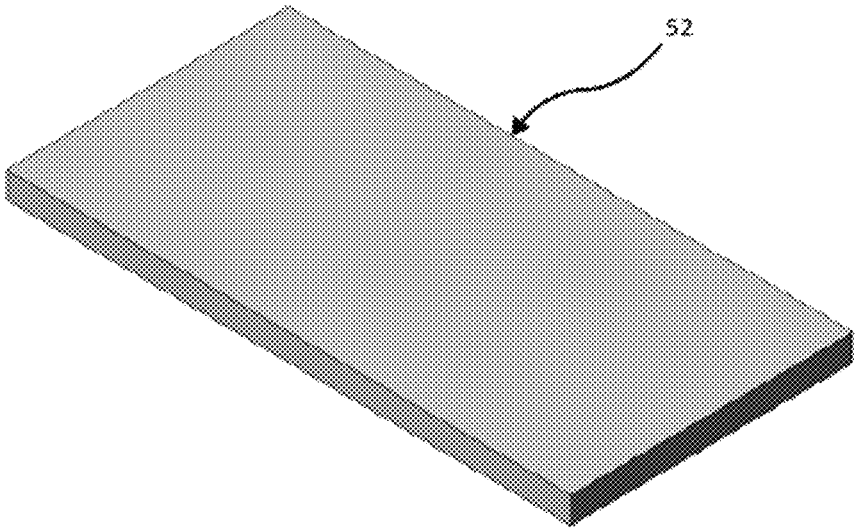
Figure 33:
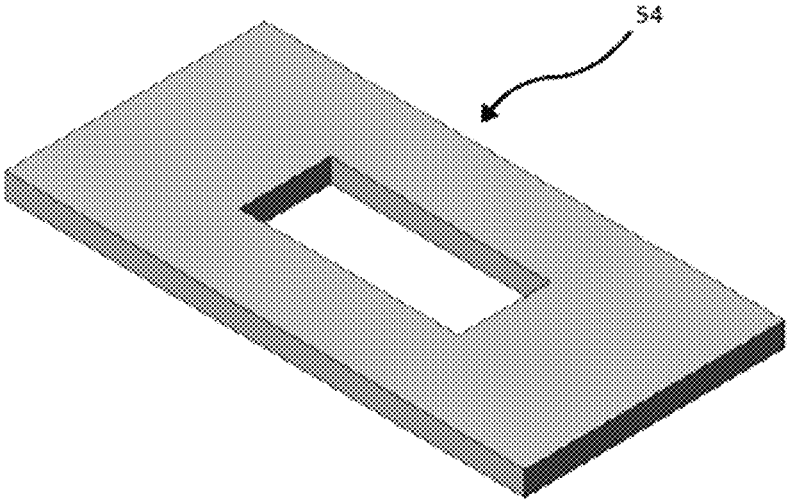

FIGS. 31, 32, and 33 show three different sizes of ceiling panels, square ceiling panel 50, rectangular ceiling panel 52, and rectangular ceiling panel with opening 54. The thickness of the ceiling panels is arbitrary, depending on structural requirements or other considerations. In this instantiation, the ceiling panels are approximately six inches thick. The length and width of ceiling panels are integer multiple of the grid spacings in both directions. The interior finish of the ceiling panels can vary based on the specification of the final design and is not dependent on the underlying geometries.

Figure 34:
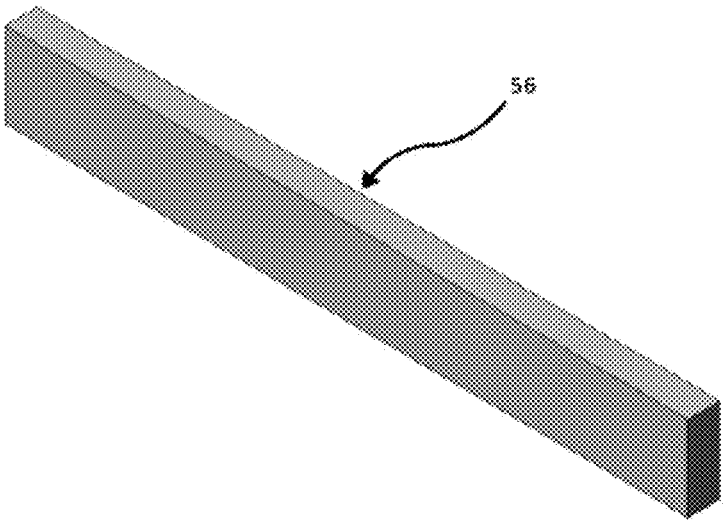
FIGS. 34, 35 and 36 show three different sizes of floor panel borders in an embodiment of the present invention.
Figure 35:
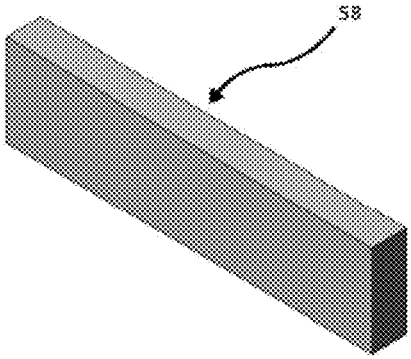
Figure 36:
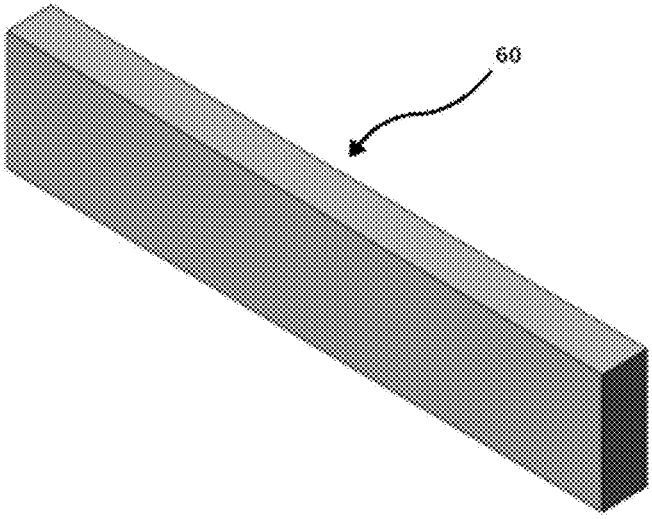

FIGS. 34, 35 and 36 show three different sizes of floor panel borders having a thickness equal to the floor panel thickness and a width equal to one half the wall panel thickness. The construction system may include one or more unique floor panel border parts each having a different length. The number of floor panel border parts, and their respective lengths, are chosen to ensure the end of each part, as installed, is coincident with a grid point or the midpoint of a grid line. In addition, one or more floor panel 1× 60 are included so that the end of this part is coincident with the exterior surface of the floor panel border forming an exterior corner. In this instantiation, FIG. 34 shows a floor panel border 2× 56 with a length equal to half of one square grid spacing plus one half of the wall panel thickness. FIG. 35 shows a floor panel border ½× 58 with a length equal to half of one square grid spacing. FIG. 36 shows a floor panel border 1× 60 with a length equal to one square grid spacing. This combination of parts can wrap any combination of connected floor panels without any gaps or overhangs. Floor panel borders 56/58/60 shown in FIGS. 34, 35, and 36 are used for implementation for variation of the foundation edge and supports the exterior dimensions of the wall panels on the perimeter of the structure and provide the weather proofing between the foundation and wall panels.

Figure 37:
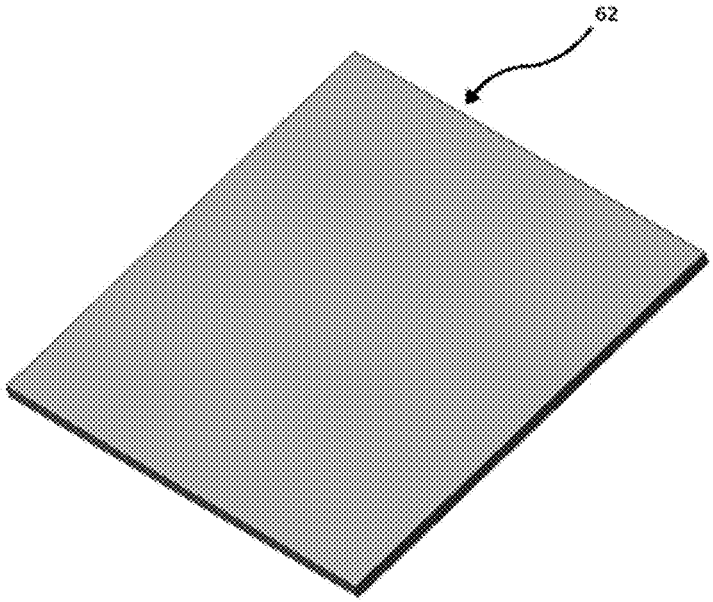
FIG. 37 shows a rectangular small roof panel of arbitrary thickness in an embodiment of the present invention.

FIG. 37 shows a rectangular small roof panel 62 of arbitrary thickness which is selected according to structural requirements or other considerations. The surfaces perpendicular to the roof ridge and the edges of the bottom face parallel to the roof ridge centered vertically over grid lines. For this instantiation, in the direction parallel to the roof ridge, the rectangular small roof panel 62 is one grid spacing wide. In the direction perpendicular to the roof ridge, the rectangular small roof panel 62 is slightly wider than one grid spacing in order to accommodate for the roof slope. The exterior and insulation finish of the rectangular small roof panel 62 can vary based on the specification of the final design and is not dependent on the underlying geometries.

Figure 38:
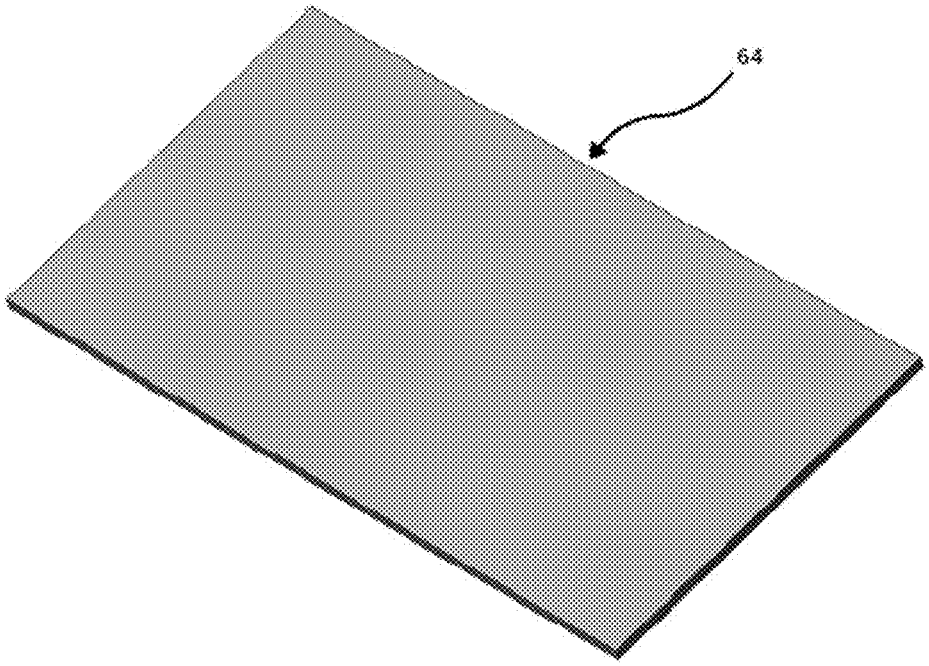
FIG. 38 shows a rectangular large roof panel in an embodiment of the present invention.

FIG. 38 shows a rectangular large roof panel 64 of arbitrary thickness which is selected according to structural requirements or other considerations. The surfaces perpendicular to the roof ridge and the edges of the bottom face parallel to the roof ridge centered vertically over grid lines. For this instantiation, in the direction parallel to the roof ridge, the rectangular large roof panel 64 is two grid spacings wide. In the direction perpendicular to the roof ridge, the rectangular large roof panel 64 is slightly wider than one grid spacing in order to accommodate for the roof slope. The exterior and insulation finish of the rectangular large roof panel 64 can vary based on the specification of the final design and is not dependent on the underlying geometries.

Figure 39:
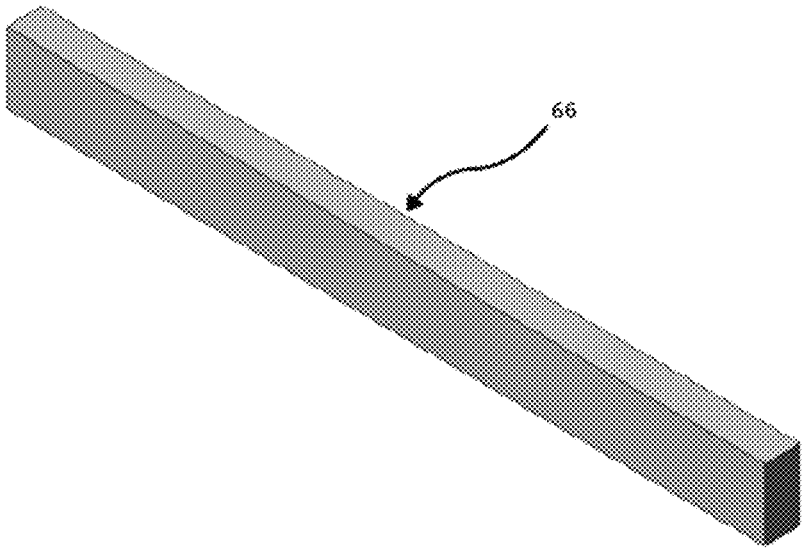
FIGS. 39, 40 and 41 show three different sizes of ceiling panel borders in an embodiment of the present invention.
Figure 40:
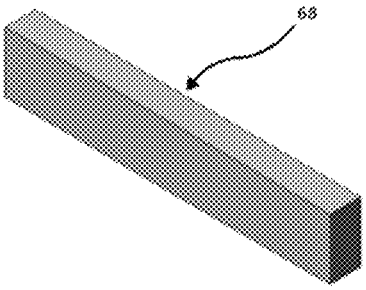
Figure 41:
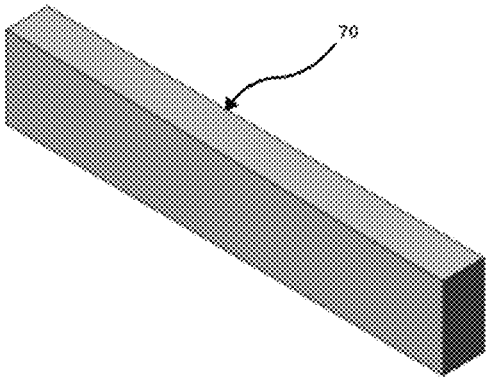

FIGS. 39, 40 and 41 show three different sizes of ceiling panel borders, having a thickness equal to the ceiling panel thickness and a width equal to one half the wall panel thickness. The construction system may include one or more unique ceiling panel border parts each having a different length. The number of ceiling panel border parts, and their respective lengths, are chosen to ensure the end of each part, as installed, is coincident with a grid point or the midpoint of a grid line. In addition, one or more ceiling panel border long parts are included so that the end of this part is coincident with the exterior surface of the ceiling panel border forming an exterior corner.

In this instantiation, FIG. 39 shows a ceiling panel border 2× 66 with a length equal to half of one square grid spacing plus one half of the wall panel thickness. FIG. 40 shows a ceiling panel border ½× 68 with a length equal to half of one square grid spacing. FIG. 41 shows a ceiling panel border 1× 70 with a length equal to one square grid spacing. This combination of parts can wrap any combination of connected ceiling panels without any gaps or overhangs. The interior finish of the ceiling panels boarder can vary based on the specification of the final design and is not dependent on the underlying geometries.

Figure 42:
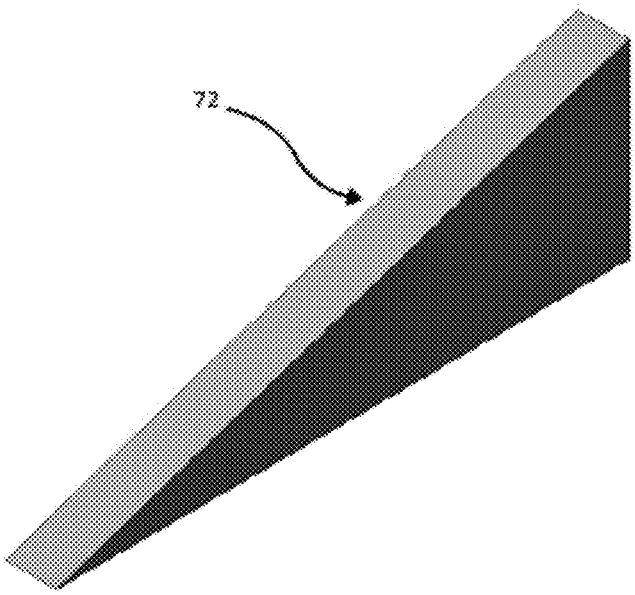
FIG. 42 shows an attic end triangle base in an embodiment of the present invention.

FIG. 42 shows an attic end triangle base 72 having a thickness equal to the wall panel thickness. The base of the attic end triangle base 72 has a length equal to a multiple of grid spacings plus one half of the wall panel thickness. The triangle height is such that the slope of the triangle matches the slope of the roof defined by its rise and run. In this instantiation, the triangle length equals one grid spacing plus one half of the wall panel thickness. The exterior and insulation finish of the attic end triangle base can vary based on the specification of the final design and is not dependent on the underlying geometries.

Figure 43:
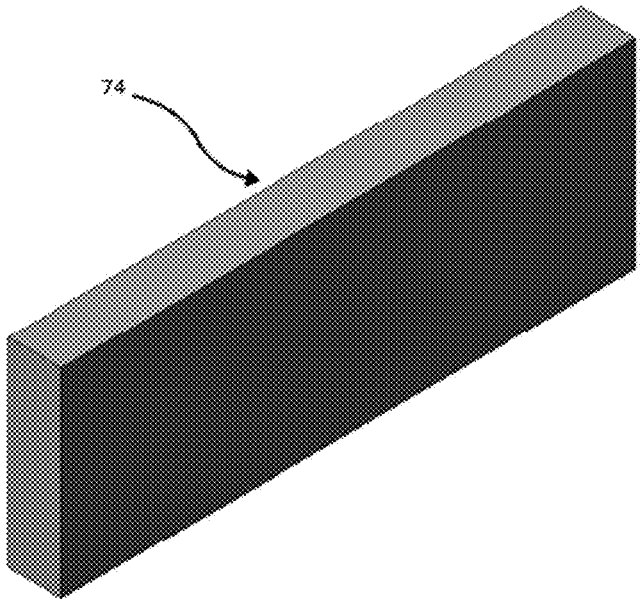
FIG. 43 shows an attic end rectangle base in an embodiment of the present invention.

FIG. 43 shows an attic end rectangle base 74 having a thickness equal to the wall panel thickness, a length equal to a multiple of grid spacings, and a height equal to the height of the attic end triangle base 72. In this instantiation, the rectangle width equals one grid spacing. The exterior and insulation finish of the attic end rectangle base 72 can vary based on the specification of the final design and is not dependent on the underlying geometries.

Figure 44:
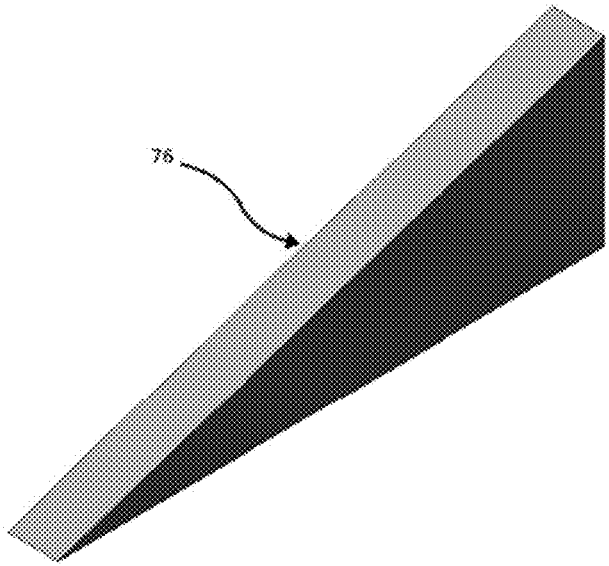
FIG. 44 shows and attic end triangle in an embodiment of the present invention.

FIG. 44 shows an attic end triangle 76 having a thickness equal to the wall panel thickness, a length equal to a multiple of grid spacing, and a height such that the triangle slope matches the roof slope defined by its rise and run. In this instantiation, the triangle width is equal a single square grid spacing. The exterior and insulation finish of the attic end triangle 76 can vary based on the specification of the final design and is not dependent on the underlying geometries.

Figure 45:
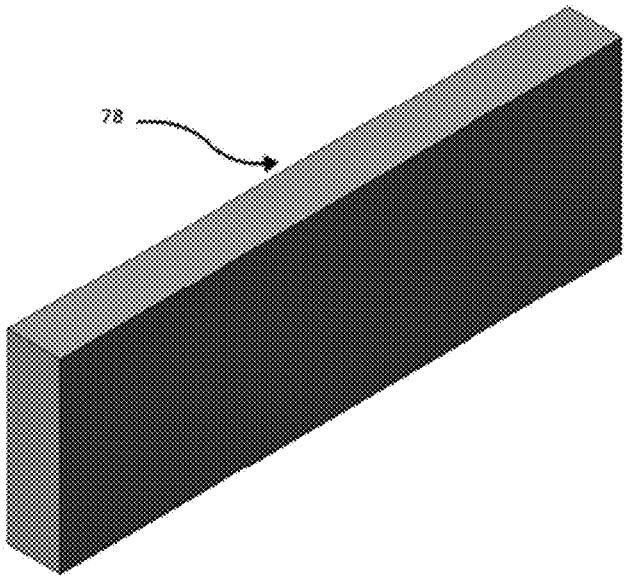
FIG. 45 shows an attic end rectangle in an embodiment of the present invention.

FIG. 45 shows an attic end rectangle 78 having a thickness equal to the wall panel thickness, a length equal to a multiple of grid spacings, and a height equal to the attic end triangle 76 height. In this instantiation, the rectangle width is equal to a single square gird spacing. The exterior and insulation finish of the attic end rectangle 78 can vary based on the specification of the final design and is not dependent on the underlying geometries.

Figure 46:
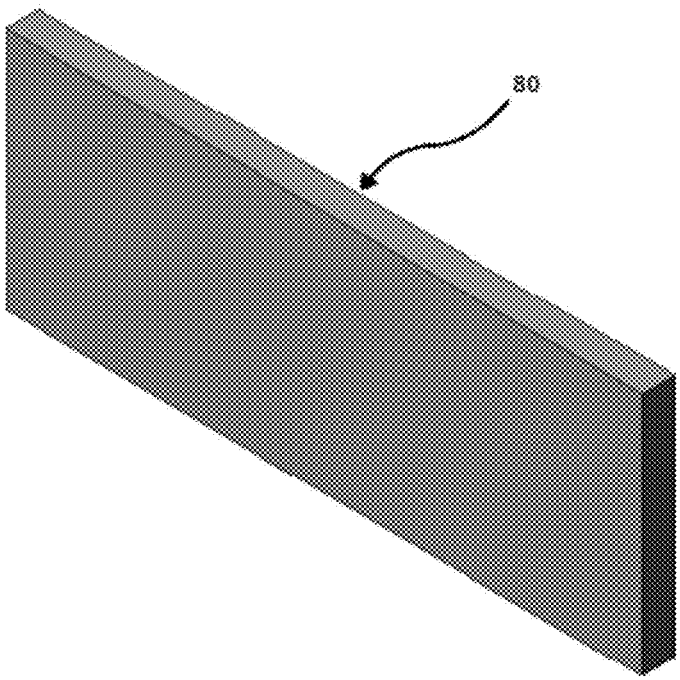
FIG. 46 shows an attic side rectangle base in an embodiment of the present invention.

FIG. 46 shows an attic side rectangle base 80 having a thickness equal to one half the wall panel thickness, a length equal to a multiple of grid spacings, and a height equal to the height of the attic end rectangle base 74. In this instantiation, the length is equal to a single grid spacing less one half of the wall panel thickness. The exterior and insulation finish of the attic side rectangle base 80 can vary based on the specification of the final design and is not dependent on the underlying geometries.

Figure 47:
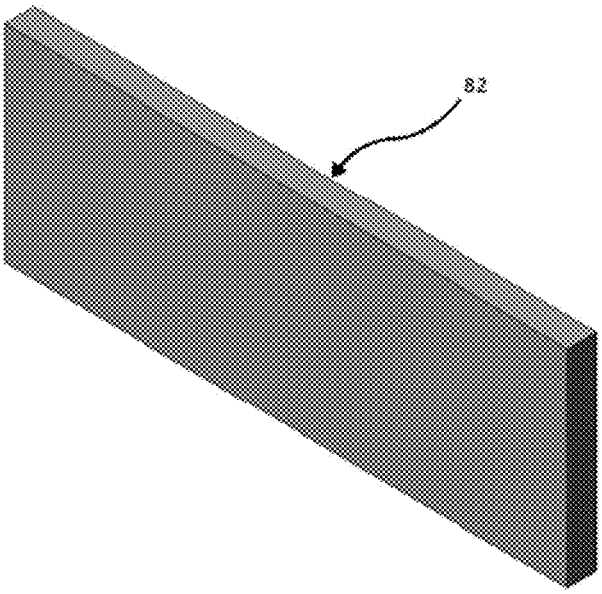
FIG. 47 shows an attic side rectangle in an embodiment of the present invention.

FIG. 47 shows an attic side rectangle 82 having a thickness equal to one half the wall panel thickness, a length equal to a multiple of grid spacings, and a height equal to the height of the attic end rectangle base 74. In this instantiation, the length is equal to a single grid spacing less one half of the wall panel thickness. The exterior and insulation finish of the attic side rectangle 82 can vary based on the specification of the final design and is not dependent on the underlying geometries.

Figure 48:
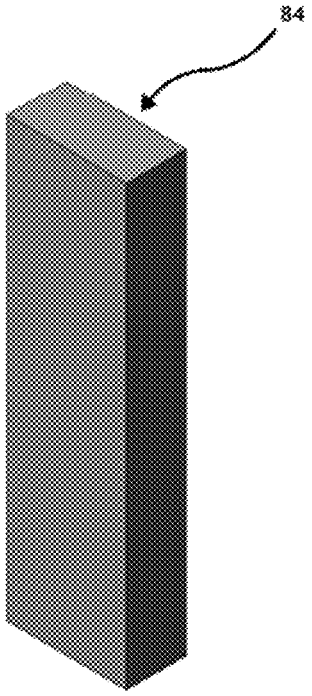
FIG. 48 shows an attic side spacer base in an embodiment of the present invention.

FIG. 48 shows an attic side spacer base 84 having a thickness equal to one half the wall panel thickness, a width dependent on the wall panel width, and a height of attic side rectangle base 80. The exterior and insulation finish of the attic side spacer base can vary based on the specification of the final design and is not dependent on the underlying geometries.

Figure 49:
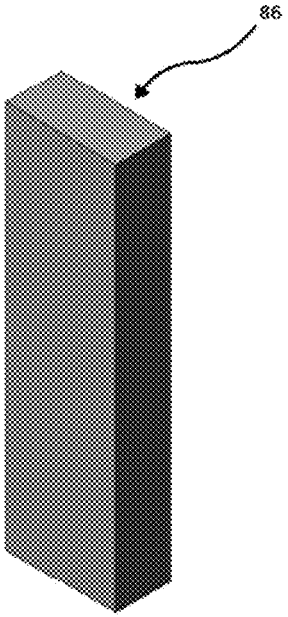
FIG. 49 shows an attic side spacer in an embodiment of the present invention.

FIG. 49 shows an attic side spacer 86 having a variable thickness dependent on a wall panel thickness, a width dependent on the wall panel width, and a height of attic side rectangle 82. The exterior and insulation finish of the attic side spacer can vary based on the specification of the final design and is not dependent on the underlying geometries.

Figure 50:
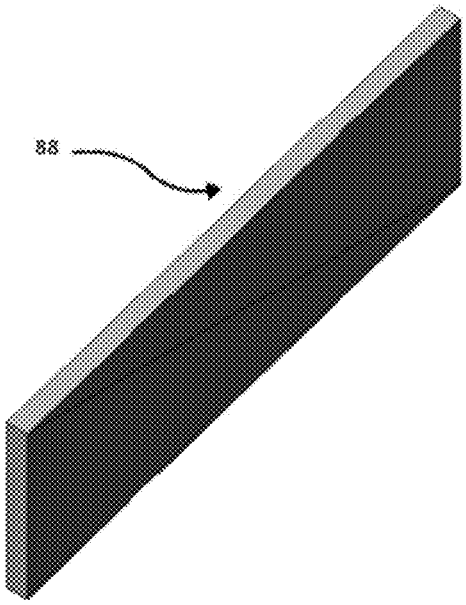
FIG. 50 shows a roof rafter parallelogram in an embodiment of the present invention.

FIG. 50 shows a roof rafter parallelogram 88 having a thickness dependent on the wall panel thickness, and the roof panel thickness. The horizontal length between the two vertical sides is a multiple of a grid spacing. The height of the vertical sides is arbitrary, depending on structural requirements or other considerations. The angles between the vertical and sloped sides match the slope defined by the roof's rise and run.

Figure 51:
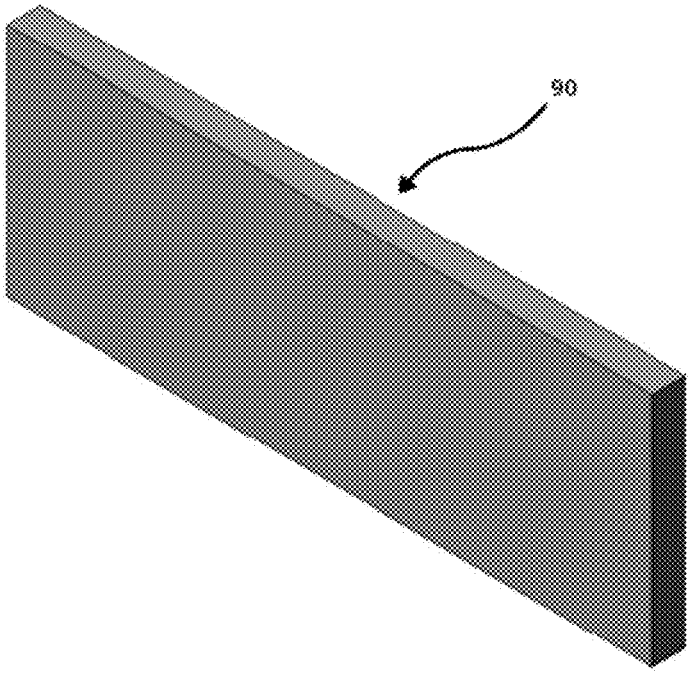
FIG. 51 shows a roof ridge rectangle in an embodiment of the present invention.

FIG. 51 shows a roof ridge rectangle 90 having an arbitrary thickness and height determined by structural, and other, considerations. The rectangle length equals a multiple of the grid spacing less the thickness of the wall panel.

Figure 52:
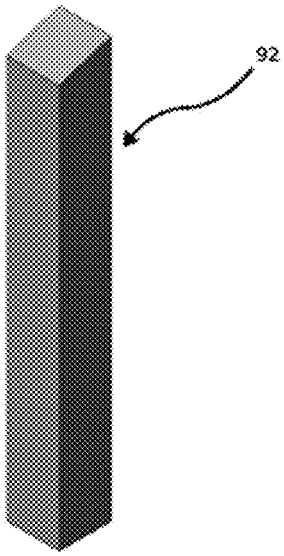
FIG. 52 shows an attic column in an embodiment of the present invention.

FIG. 52 shows an attic column 92 which can have an arbitrary cross section. In this instantiation, the cross section is square with a width equal to the wall panel thickness. The bottom of the attic column rests on a wall panel and the top is coincident with a roof rafter parallelogram 88.

Figure 53:
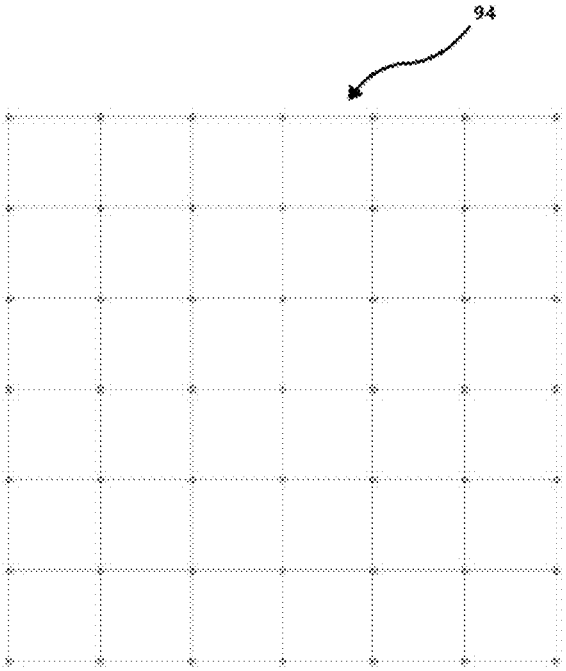
FIG. 53 shows a conceptual rectangular point grid in an embodiment of the present invention.
Figure 54:
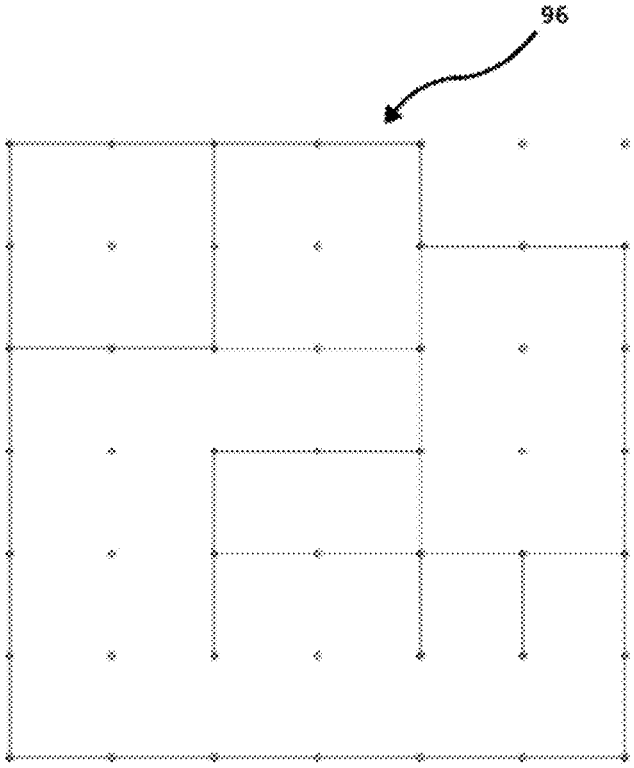
FIG. 54 shows grid lines that connect grid points for an instantiation of a floor plan in an embodiment of the present invention.

FIG. 53 shows a conceptual rectangular point grid 94. The component dimensions are based on the dimensions of the conceptual rectangular point grid 94 shown in FIG. 53. Grid lines along the x axis may all be of one length, and grid lines along the y axis may all be of one length that is a different length from the grid lines along the x axis. All the grid lines are at right angles to each other. The z direction extends upward from the plane of rectangular point grid 94. Rectangular point grid 94 in this instantiation is square, having 54 inches between the points in both directions in one embodiment. Grid lines connect grid points as shown in FIG. 54. The grid dimensions depicted in FIGS. 53 and 54 highlight the versatility of the component layouts. FIG. 54 depicts a three-bedroom two-bathroom floorplan but is not limited to this specific floorplan. The grid spacing in FIG. 53 can be applied to but is not limited to floorplans that include one bedroom one bathroom, two bedrooms one bathroom, three bedrooms one bathroom, four bedrooms one bathroom, two-bedroom two-bathrooms, four-bedroom two-bathrooms, etc. rectangular point grid 94 represents one story floorplans that can also be utilized in, but is not limited to, structural floorplans of up to six stories. Floorplans of one-story, two-stories, and three-stories, four-stories, five-stories, and six-stories can be accommodated with a subsequent basement, flat slab foundation, helical pier foundation, or continuous skirt wall foundation. The material used for these structures is not dependent on the geometries. The grid can accommodate but is not limited to materials such as virgin or recycled plant based pressed bio board, timber paneling, or 3D printed plant based substrate (made from but not limited to straw, hemp, corn husk, recycled cardboard, or other plant based materials); virgin or recycled cold formed, cast, hot rolled, or 3D printed steel; virgin or recycled extruded, molded extruded, 3D printed plastic; cast concrete, cast AeroCrete, 3D printed concrete or AeroCrete; cold formed aluminum, cast aluminum, rolled aluminum, extruded aluminum, 3D printed aluminum; formed earthen substrate, molded earthen substrate, extruded molded earthen substrate, 3D printed earthen substrate, or other materials still undefined and under development for earth based or non-earth based applications.

FIG. 54 shows grid lines that connect grid points for a floor plan 96. To begin the design process, a designer of a dwelling or other structure designs a floor plan having interior and exterior walls laid out along grid lines, with the endpoints of all line segments representing the walls coincident with grid points. FIG. 54 shows one instantiation of a preliminary floor plan 96 for a particular three-bedroom dwelling.

Figure 55:
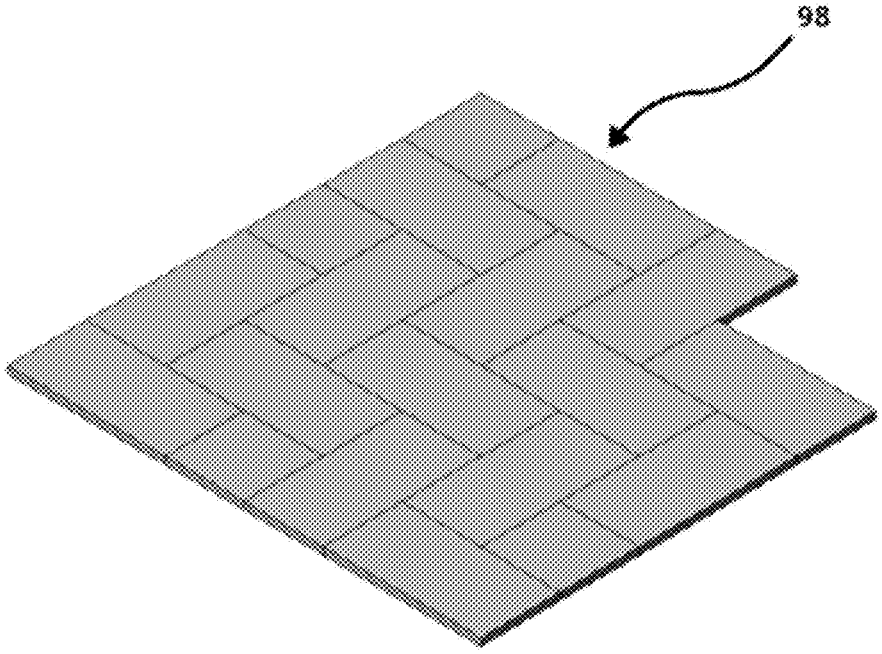
FIG. 55 shows the assembly of rectangular and square floor panels into a floor subassembly for this instantiation in an embodiment of the present invention.

FIG. 55 shows the assembly of rectangular and square floor panels 34 into the floor subassembly 98 for this instantiation. The floor subassembly 98 is connected to a foundation. Different tiling patterns that fill the perimeter of the floor plan are possible. FIG. 55 shows a herringbone configuration, selected to provide structural stiffness to the floor subassembly. The corners of the square and rectangular floor panels as well of the midpoints of the long sides of the rectangular floor panels are coincident with grid points. The edges of the floor panels are coincident with grid lines. FIG. 55 depicts one application of multiple square floor panels 34 shown in FIG. 23 and multiple rectangular floor panels 36 shown in FIG. 24 but is not limited to this configuration. The herringbone configuration in FIG. 55 in floor subassembly 98 is one example of how the square floor panels 34 and rectangular floor panels 36 can be applied but does not represent the only configuration of the defined floor panels.

Figure 56:
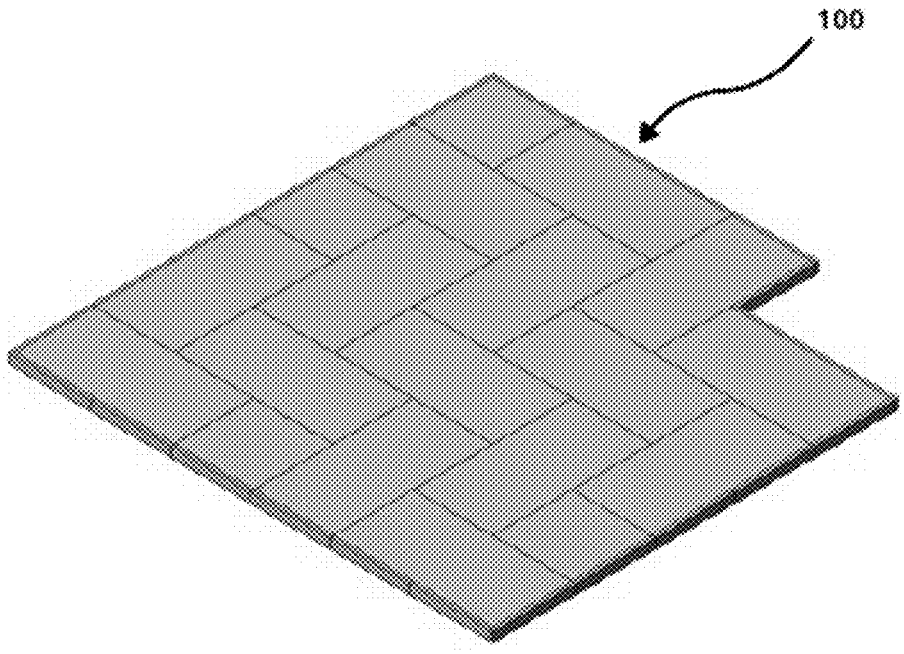
FIG. 56 shows a plurality of floor border components attached to the perimeter of the floor subassembly shown in FIG. 55 in an embodiment of the present invention.

FIG. 56 shows a plurality of floor border components attached to the perimeter of the floor border subassembly 100. The lengths of the various floor border components are such that they completely encircle the floor panels without any gaps or overhangs. The herringbone configuration is one example of how the floor panel border 2× 56, floor panel border ½× 58, and floor panel border 1× 60 can be applied to the grid geometries. Floor border components added to floor subassembly depicts how floor panel border 2× 56, floor panel border ½× 58, and floor panel border 1× 60 can be applied but does not represent the only configuration of the defined floor panels.

FIGS. 57, 58, 59 and 60 show assemblies of wall panel columns connecting two, three, or four wall panels where the wall panel columns abut against the wall panels and are connected thereto. These assemblies will be connected to instantiate a particular floor plan. If the floor plan calls for a wall to end inside the dwelling (i.e., not in a corner or other configuration), a wall panel column 48 terminates the wall and is coincident with a grid point. The wall assemblies depicted in FIGS. 57, 58, 59 and 60 can be constructed from but are not limited to the materials discussed above in reference to FIG. 53.

Figure 57:
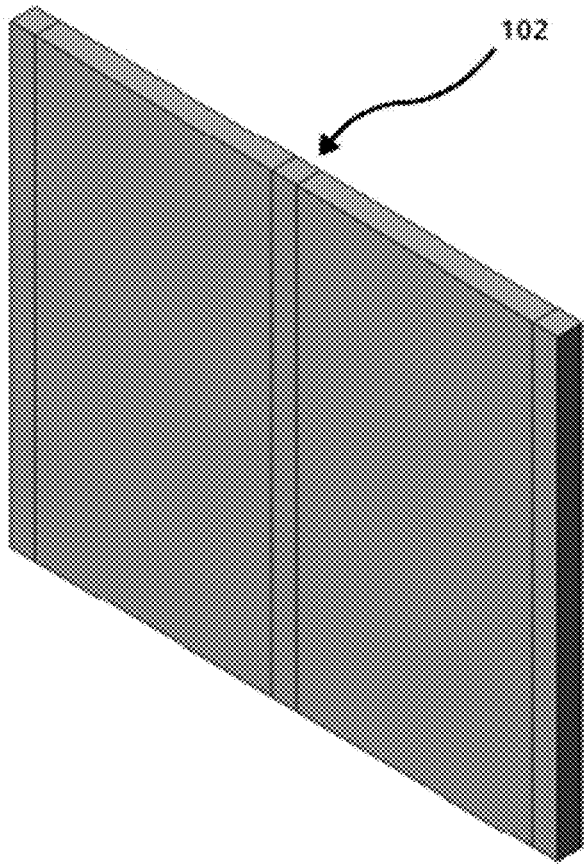
FIG. 57 shows an assembly of two wall panels connected in a parallel (in-line) fashion in an embodiment of the present invention.
Figure 58:
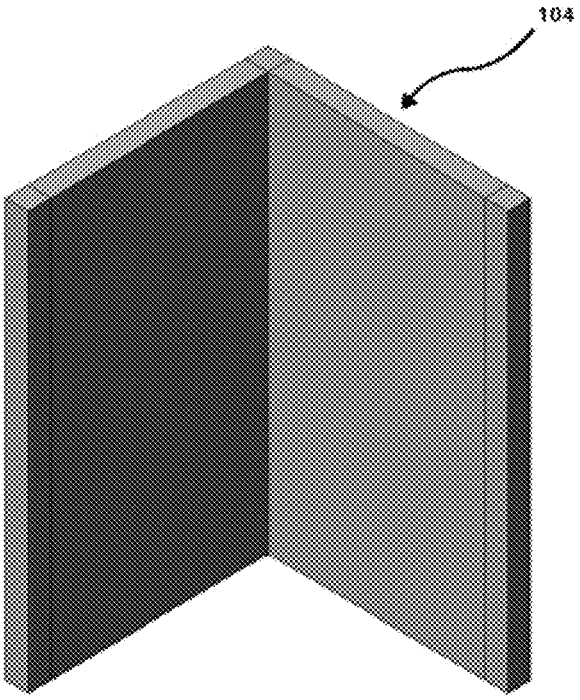
FIG. 58 shows an assembly of two wall panels connected in a perpendicular fashion in an embodiment of the present invention.

FIG. 57 shows parallel wall assembly 102 which is an assembly of two wall panels connected in a parallel (in-line) fashion. The parallel wall assembly 102 depicted in FIG. 57 can be constructed from but is not limited to the materials discussed above in reference to FIG. 53. FIG. 58 shows perpendicular wall assembly 104 which is an assembly of two wall panels connected in a perpendicular fashion. This may be either an interior or exterior corner of the floor plan. The perpendicular wall assembly 104 depicted in FIG. 58 can be constructed from but is not limited to the materials discussed above in reference to FIG. 53.

Figure 59:
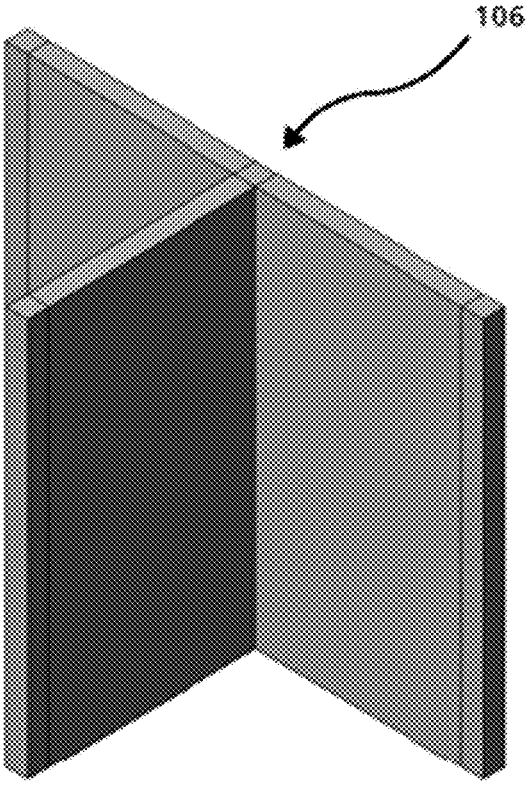
FIG. 59 shows an assembly of three wall panels connected in a "T" configuration in an embodiment of the present invention.

FIG. 59 shows "T" wall assembly 108 which is an assembly of three wall panels connected in a "T" configuration. The "T" wall assembly 108 depicted in FIG. 59 can be constructed from but is not limited to the materials discussed above in reference to FIG. 53.

Figure 60:
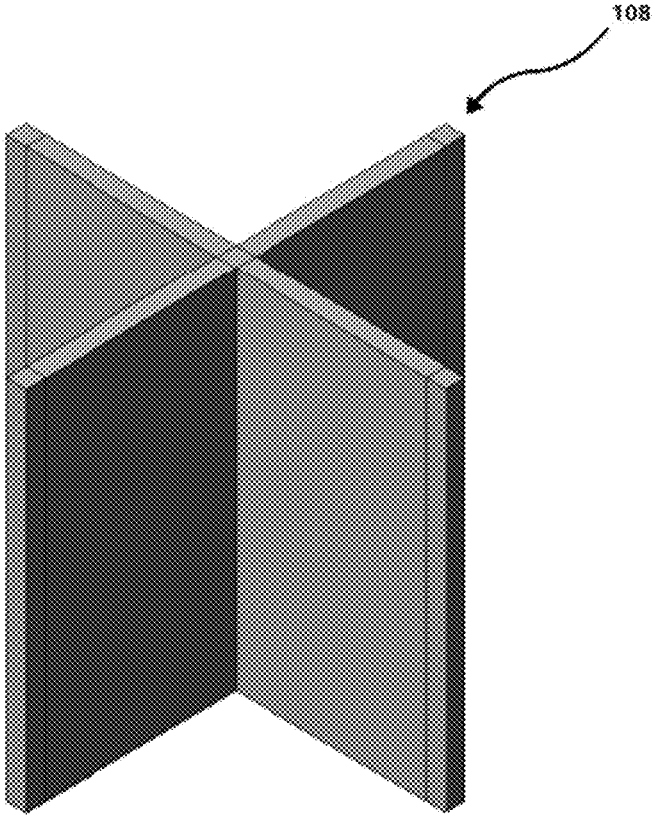
FIG. 60 shows an assembly of four wall panels connected in a "Plus" (or "Cross") configuration in an embodiment of the present invention.

FIG. 60 shows plus wall assembly 108 which is an assembly of four wall panels connected in a "plus" (or "cross") configuration. The plus wall assembly 108 depicted in FIG. 60 can be constructed from but is not limited to the materials discussed above in reference to FIG. 53.

Figure 61:
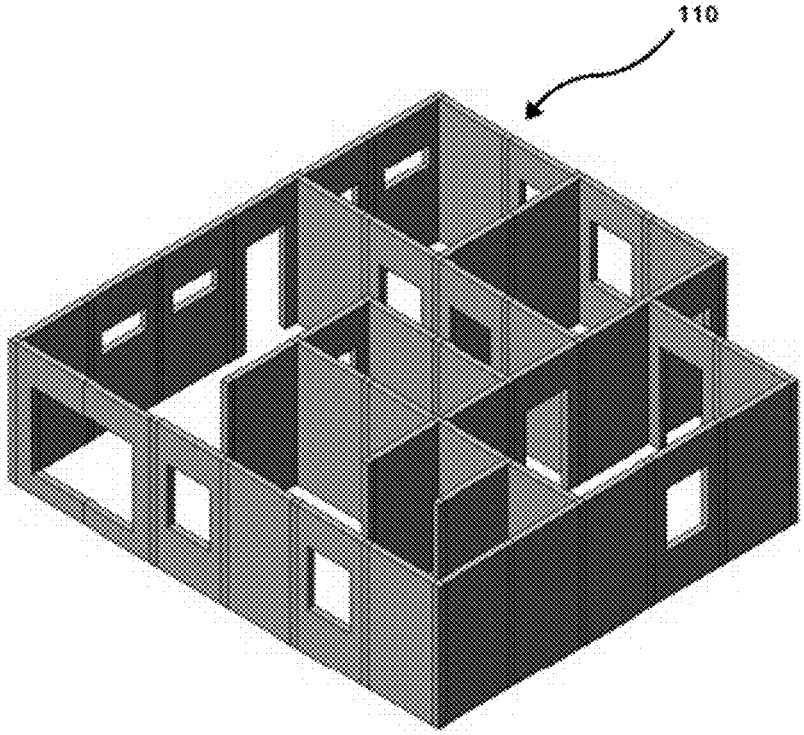
FIG. 61 shows an assembly of wall panels and wall columns instantiating the particular floorplan shown in FIG. 54 for a three-bedroom dwelling in an embodiment of the present invention.

FIG. 61 shows an assembly of wall panels and wall panel columns that are attached on top of the floor subassembly 98 shown in FIG. 55 and the floor border components shown in FIG. 56, instantiating a particular floor plan for a three-bedroom dwelling 110. Each wall panel column is centered vertically over one grid point. Each panel wall is centered vertically over a grid line. The exterior surface of exterior wall panels is coincident with the exterior surfaces of one or more floor border components. The exterior and interior finishes of each wall panel is not dependent on the geometries of the highlighted configuration. FIG. 61 depicts a three-bedroom two-bathroom floorplan but is not limited to this specific floorplan. The three-bedroom dwelling 110 in FIG. 61 can be modified and applied to but is not limited to floorplans that include one bedroom one bathroom, two bedrooms one bathroom, three bedrooms one bathroom, four bedrooms one bathroom, two-bedroom two-bathrooms, four-bedroom two-bathrooms, etc. rectangular point grid 94 represents one story floorplans that can also be utilized in but is not limited to structural floorplans of up to six stories. Floorplans of one-story, two-stories, and three-stories, four-stories, five-stories, and six-stories can be accommodated with a subsequent basement, flat slab foundation, helical pier foundation, or continuous skirt wall foundation. The wall assemblies depicted in FIG. 61, can be constructed from but is not limited to the materials discussed above n reference to FIG. 53.

Figure 62:
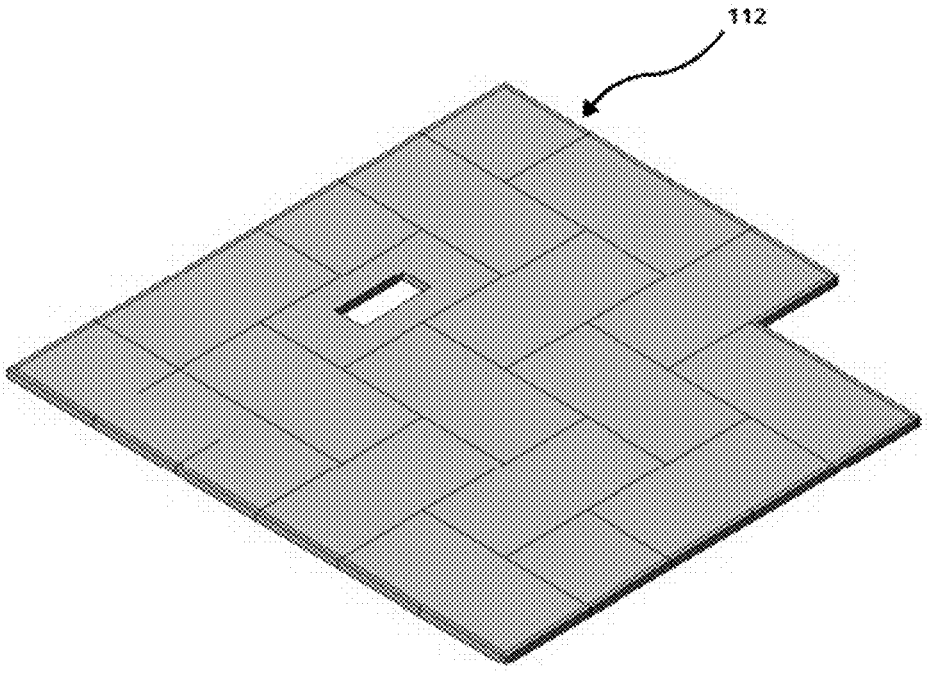
FIG. 62 shows an assembly of ceiling panels and ceiling border components instantiating the three-bedroom dwelling shown in FIG. 61 in an embodiment of the present invention.

FIG. 62 shows a ceiling subassembly 112 of ceiling panels and ceiling border components instantiating the three-bedroom dwelling 110. Similar to the floor subassembly 98 in FIG. 55, ceiling panels are shown arranged in a herringbone configuration, although other tiling patterns are possible. In a similar fashion, ceiling borders are attached to the perimeter of the assemblage of ceiling panels and encircle it without gaps or overhangs. The corners of ceiling panels are coincident with grid points and the edges of ceiling panels are coincident with grid lines. The interior insulation finishes of each ceiling panel is not dependent on the geometries of the highlighted configuration. FIG. 62 depicts a three-bedroom two-bathrooms floorplan but is not limited to this specific floorplan. The ceiling subassembly 112 in FIG. 62 can be modified and applied to but is not limited to floorplans that include one-bedroom one-bathroom, two-bedrooms one-bathroom, three-bedrooms one-bathroom, four-bedrooms one-bathroom, two-bedroom two-bathrooms, four-bedroom two-bathrooms, etc. rectangular point grid 94 represents one story floorplans that can also be utilized in but is not limited to structural floorplans of up to six stories. The ceiling subassembly 112 depicted in FIG. 62 can be constructed from but is not limited to the materials discussed above in reference to FIG. 53.

Figure 63:
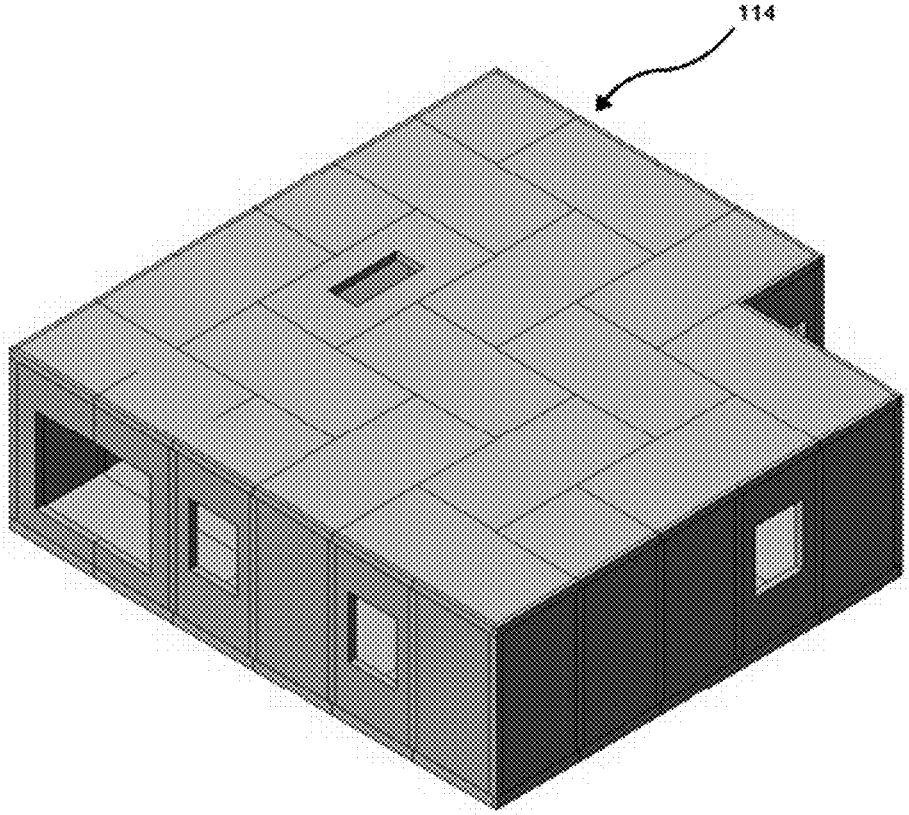
FIG. 63 shows the ceiling panel assembly attached to the tops of the wall panels and wall panel columns shown in FIG. 61 in an embodiment of the present invention.

FIG. 63 shows base level assembly 114 showing ceiling subassembly 112 attached to the tops of the wall panels and wall panel columns of three-bedroom dwelling 110. FIG. 63 highlights an assembly of the ceiling subassembly 112, which can be installed on top of the wall assembly or in the interior surface of the wall assembly. The exterior surfaces or the ceiling border components are coincident with the exterior surfaces of exterior wall panels. The ceiling subassembly 112 covers the entire floor plan without gaps or overhangs. FIG. 63 depicts a three-bedroom two-bathrooms floorplan but is not limited to this specific floorplan. The ceiling subassembly 112 in FIG. 63 can be modified and applied to but is not limited to floorplans that include one bedroom one bathroom, two bedrooms one bathroom, three bedrooms one bathroom, four bedrooms one bathroom, two-bedroom two-bathrooms, four-bedroom two-bathrooms, etc. rectangular point grid 94 represents one-story floorplans that can also be utilized in but is not limited to structural floorplans of up to six-stories.

Figure 64:
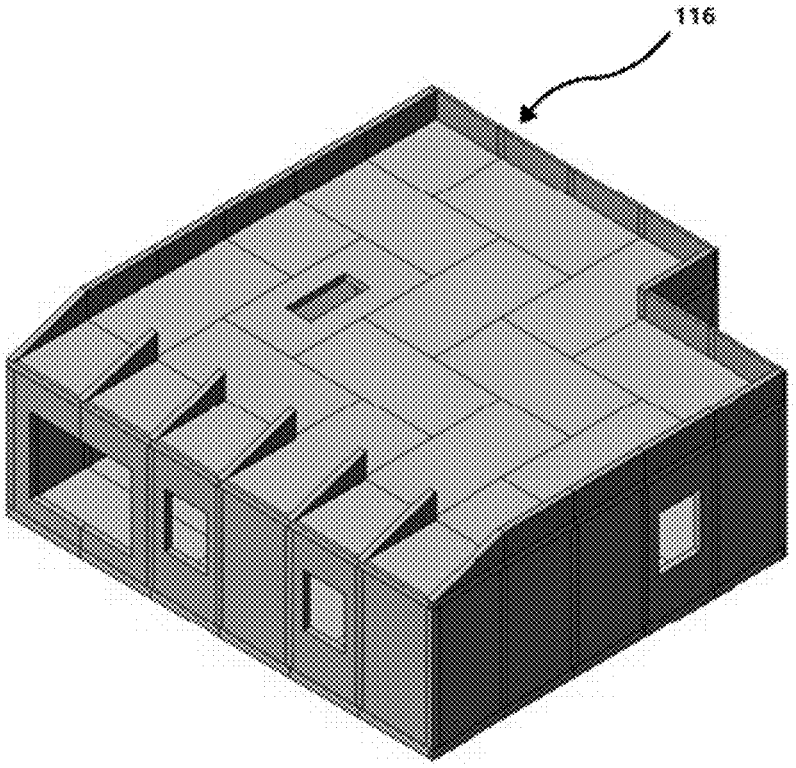
FIG. 64 shows an assemblage of attic end triangle bases, attic end rectangle bases, attic side rectangle bases, and attic side spacer bases attached to the top of the ceiling panel assembly in an embodiment of the present invention.

FIG. 64 shows base level attic components assemblage 116 which is an assemblage of attic end triangle bases 72, attic end rectangle bases 74, attic side rectangle bases 80, and attic side spacer bases 84 attached to the top of the ceiling subassembly 112. FIG. 64 depicts a three-bedroom two-bathrooms floorplan but is not limited to this specific floorplan. The attic end triangle bases can be rearranged and applied to but is not limited to floorplans that include one bedroom one bathroom, two bedrooms one bathroom, three bedrooms one bathroom, four bedrooms one bathroom, two-bedroom two-bathrooms, four-bedroom two-bathrooms, etc. rectangular point grid 94 represents one story floorplans that can also be utilized in but is not limited to structural floorplans of up to six stories.

Figure 65:
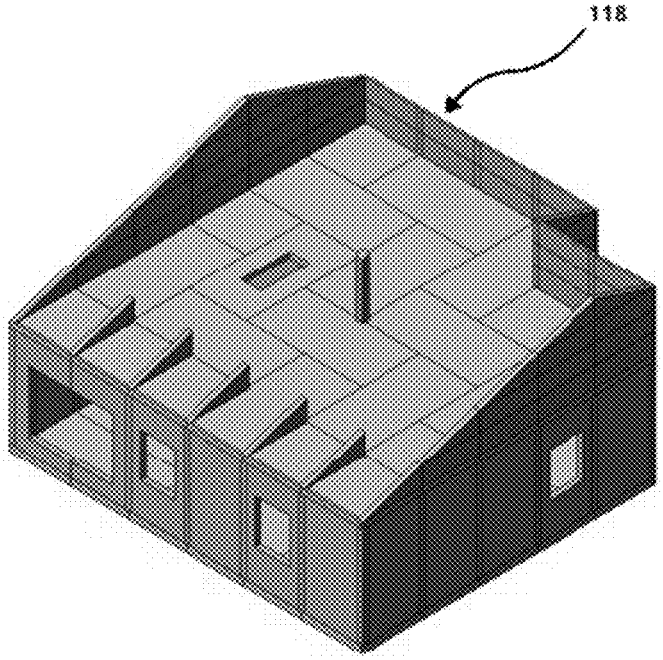
FIG. 65 shows an assemblage of attic end triangles, attic end rectangles, attic side rectangles, and attic side spacers, and an attic column attached to the assembly shown in FIG. 64 in an embodiment of the present invention.

FIG. 65 shows the attic components assemblage, which is an assemblage of attic end triangles 76, attic end rectangles 78, attic side rectangles 82, and attic side spacers 86, and an attic column 92 attached to the base level attic components assemblage 116 shown in FIG. 64. FIG. 65 depicts a three-bedroom two-bathrooms floorplan but is not limited to this specific floorplan. The attic end triangles 76, attic end rectangles 78, attic side rectangles 82, and attic side spacers 86, and an attic column 92 can be rearranged and applied to but is not limited to floorplans that include one bedroom one bathroom, two bedrooms one bathroom, three bedrooms one bathroom, four bedrooms one bathroom, two-bedroom two-bathrooms, four-bedroom two-bathrooms, etc. rectangular point grid 94 represents one story floorplans that can also be utilized in but is not limited to structural floorplans of up to six stories.

Figure 66:
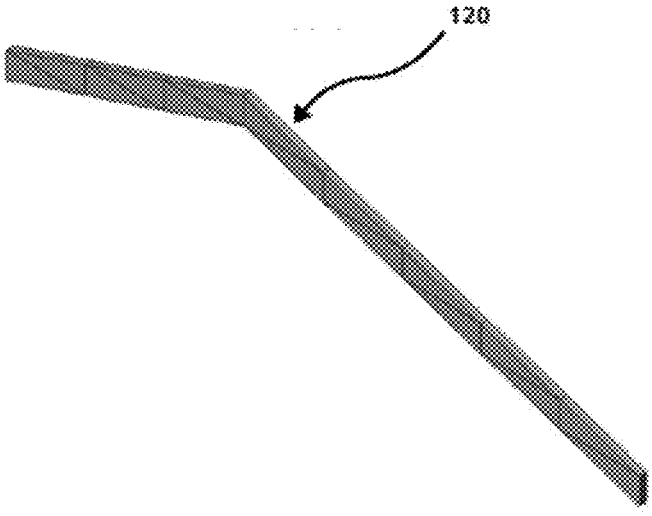
FIG. 66 shows an assemblage of roof rafter parallelograms forming a roof rafter in an embodiment of the present invention.

FIG. 66 shows roof truss assembly 120 which is an assemblage of roof rafter parallelograms 88 forming a roof rafter, allowing the construction of rafters of different lengths. Depending on the thickness of the roof rafter parallelograms 88, the roof rafter thickness is equal to either the wall panel thickness or one half of the wall panel thickness. FIG. 66 depicts one specific variation of the roof rafter parallelograms 88 but is not limited to the configuration highlighted in FIG. 66. The defined geometries in FIG. 66 can be applied to but is not limited to gable roofs, hip roofs, dutch roofs, mansard roofs, shed roofs, butterfly roofs, gambrel roofs, dormer roofs, and M shaped roofs. The roof rafter parallelograms 88 depicted in FIG. 66, can be constructed from but is not limited to the materials discussed above in reference to FIG. 53.

Figure 67:
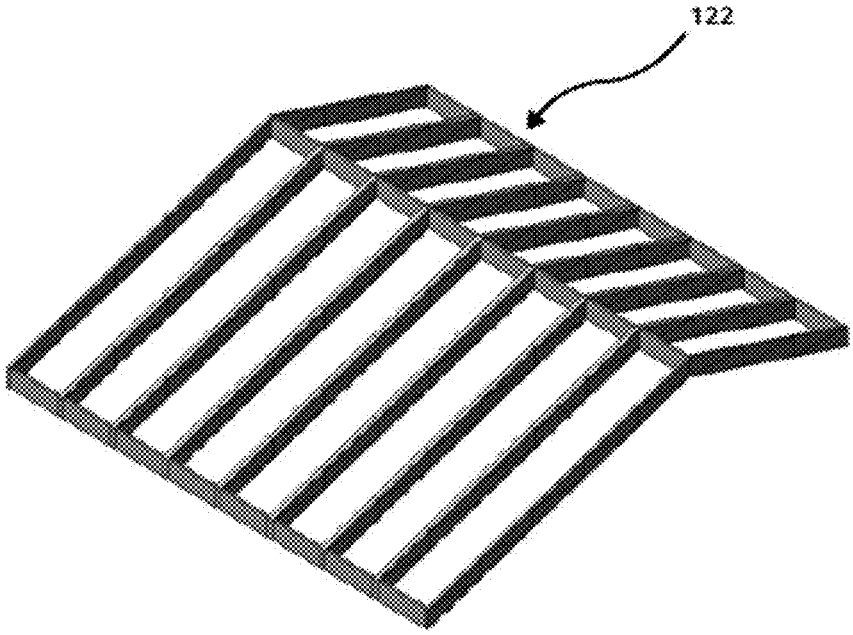
FIG. 67 shows an assemblage of roof trusses forming a roof ridge in an embodiment of the present invention.

FIG. 67 shows roof assemblage 122 an assemblage of roof truss assemblies 120 that form a roof ridge. FIG. 67 depicts one specific variation of the roof truss assemblies 120 and roof ridge but is not limited to the configuration highlighted in FIG. 67. The defined geometries in FIG. 67 can be applied to but is not limited to gable roofs, hip roofs, dutch roofs, mansard roofs, shed roofs, butterfly roofs, gambrel roofs, dormer roofs, and M shaped roofs. The roof truss assemblies 120 and roof ridge depicted in FIG. 67 can be constructed from but is not limited to the materials discussed above in reference FIG. 53.

Figure 68:
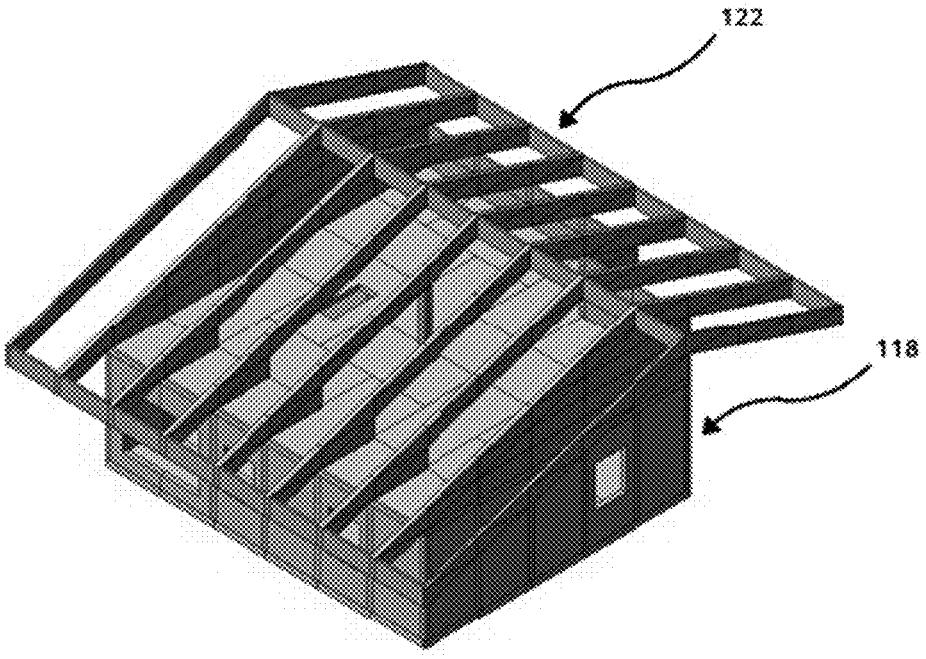
FIG. 68 shows an assemblage of roof truss assemblies, roof ridge rectangles and attic components in an embodiment of the present invention.

FIG. 68 shows roof assemblage 122 on top of all attic components assemblage 118. FIG. 68 depicts one specific variation of the roof truss assemblies, roof ridge rectangles and attic components but is not limited to the configuration highlighted in FIG. 68. The defined geometries in FIG. 68 can be applied to but is not limited to gable roofs, hip roofs, dutch roofs, mansard roofs, shed roofs, butterfly roofs, gambrel roofs, dormer roofs, and M shaped roofs. The roof rafter parallelograms 88 depicted in FIG. 68 can be constructed from but is not limited to the materials discussed above in reference to FIG. 53.

Figure 69:
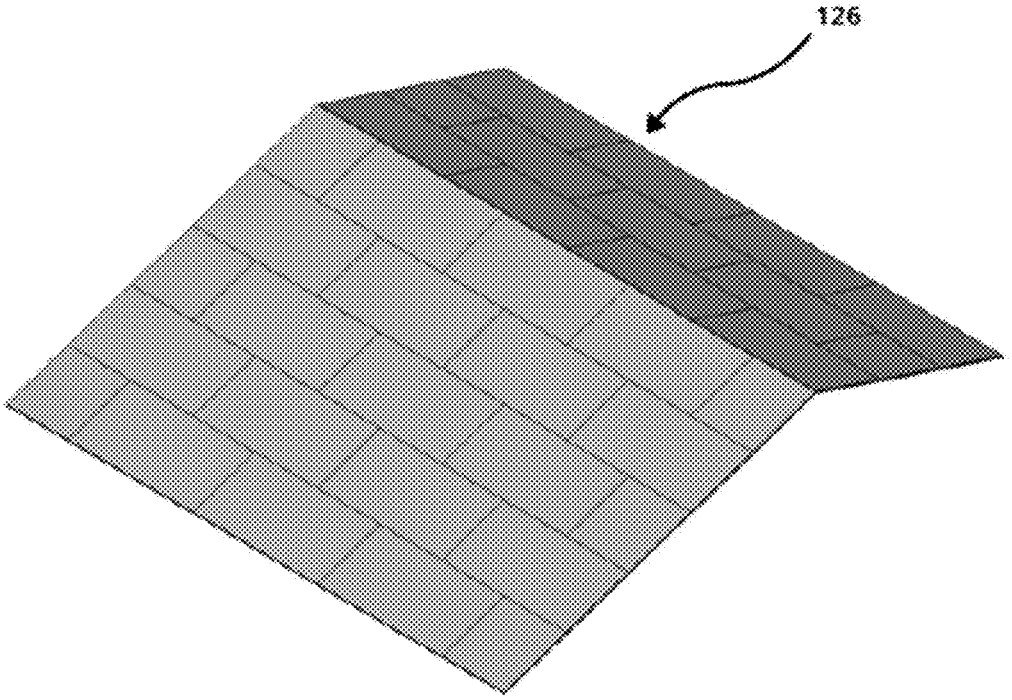
FIG. 69 shows the square and rectangular roof panels assembled into the roof assembly in an embodiment of the present invention.

FIG. 69 shows the square and rectangular roof panels assembled into the roof assembly 126. FIG. 69 depicts one specific variation of the roof panels assembled into the roof assembly 126 but is not limited to the configuration highlighted in FIG. 69. The defined geometries in FIG. 69 can be applied to but is not limited to gable roofs, hip roofs, dutch roofs, mansard roofs, shed roofs, butterfly roofs, gambrel roofs, dormer roofs, and M shaped roofs.

Figure 70:
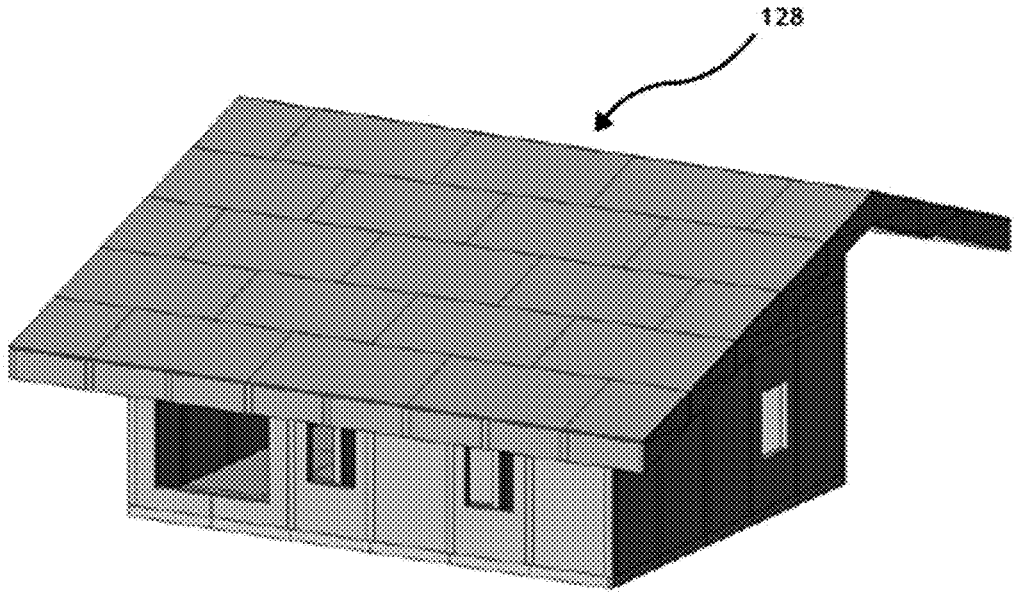
FIG. 70 shows the roof assembly attached to the truss assembly in an embodiment of the present invention.

FIG. 70 shows final assemblage 128 with roof assembly 126 attached to roof assemblage 122. FIG. 70 depicts one specific variation of the final assemblage 128 attached to the roof assemblage 122 but is not limited to the configuration highlighted in FIG. 70. The defined geometries in FIG. 70 can be applied to but is not limited to gable roofs, hip roofs, dutch roofs, mansard roofs, shed roofs, butterfly roofs, gambrel roofs, dormer roofs, and M shaped roofs.

Figure 71:
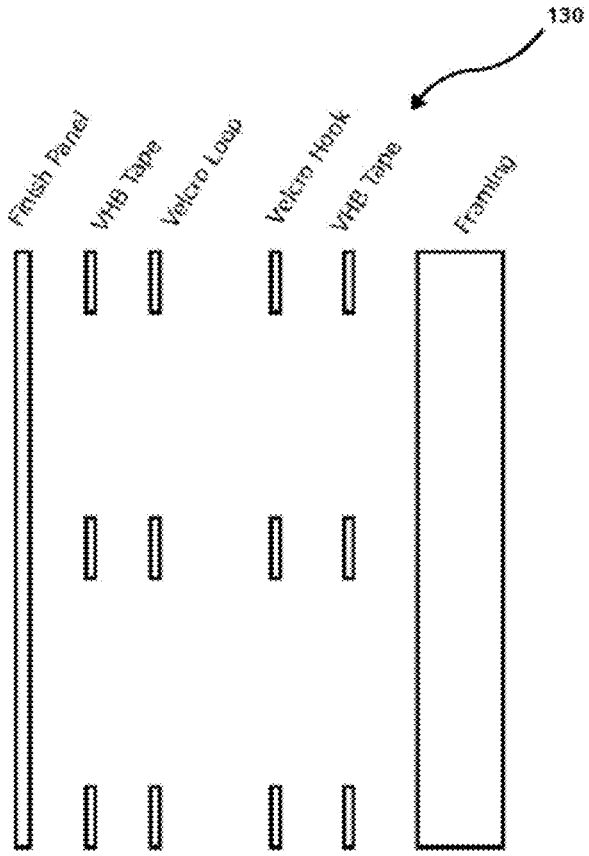
FIG. 71 shows a wall assembly composition of one instantiation method for attaching the interior or exterior finish panels to the wall panel framing in an embodiment of the present invention.

FIG. 71 shows a wall assembly composition 130 of one instantiation method for attaching the interior or exterior finish panels to the wall panel framing. The assembly highlighted in FIG. 71 utilizes Very High Bond (VHB) tape is applied to the mating surfaces of both the wall framing and the finish panel. Then, opposing halves of a high-strength Velcro, or similar component such as metal Velcro or other two-part push-to-snap connectors, are affixed to the VHB tape on both the framing and finish panel. The finish panel is aligned to the framing and connected by pushing the two components together. Wall panels may leave the manufacturing facility with either 2, 1, or no interior or exterior finish panels applied. Once installed at the dwelling site, either 1 or 2 panels will be attached to the wall panel framing. A variety of attachment methods may be employed, including but not limited to, screws, bolts, adhesives, etc. The wall assembly composition 130 depicted in FIG. 71, can be constructed from but is not limited to materials such as drywall, virgin or recycled plant based pressed bio board, timber paneling, or 3D printed plant based substrate sidings and paneling (made from but not limited to straw, hemp, corn husk, recycled cardboard, or other plant based materials); virgin or recycled cold formed, cast, hot rolled, or 3D printed steel siding and paneling; virgin or recycled extruded, molded extruded, 3D printed plastic sidings and paneling; cast concrete, cast AeroCrete, 3D printed concrete or AeroCrete sidings and paneling; cold formed aluminum, cast aluminum, rolled aluminum, extruded aluminum, 3D printed aluminum siding and paneling; formed earthen substrate, molded earthen substrate, extruded molded earthen substrate, 3D printed earthen substrate sidings and paneling; or other material still undefined and under development for earth based or non-earth based applications.

Figure 72:
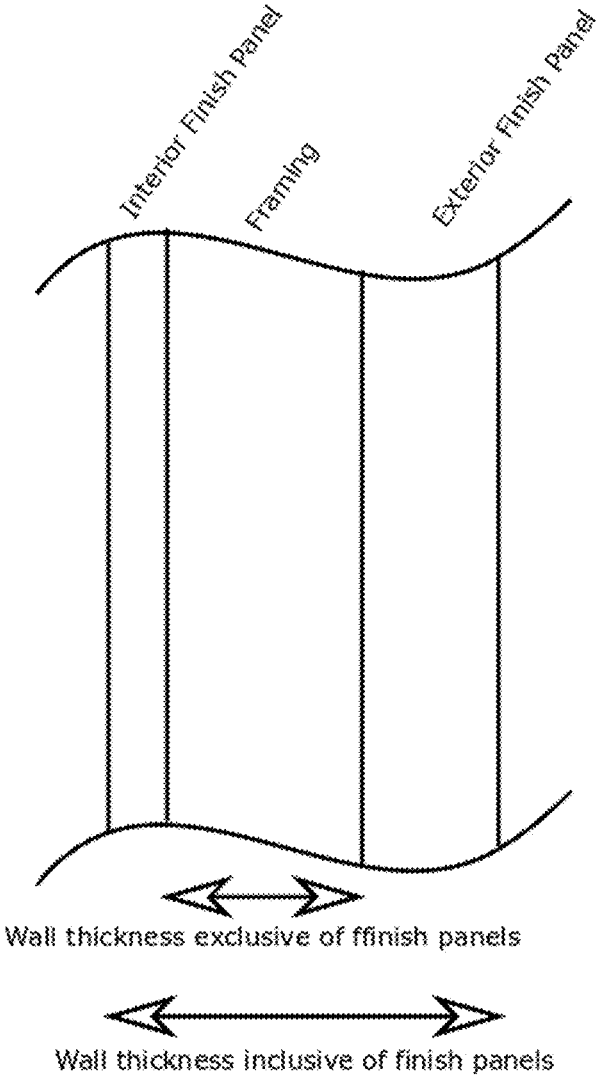
FIG. 72 shows that the wall thickness may be measured inclusive or exclusive of the interior or exterior finish panels in an embodiment of the present invention.

FIG. 72 shows that the wall thickness 132 may be measured inclusive or exclusive of the interior or exterior finish panels as shown in the FIG. 72.

Figure 73:
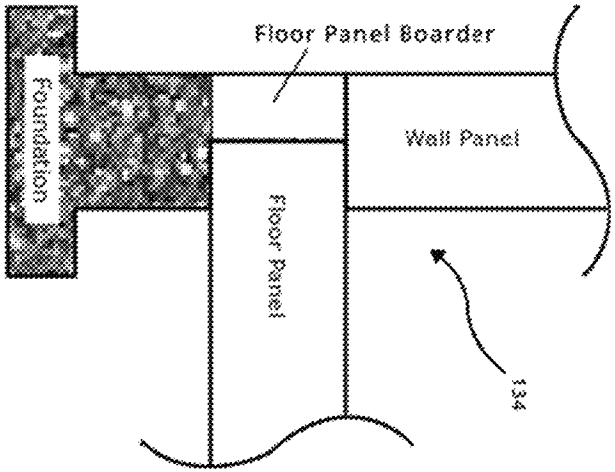
FIG. 73 shows how the floor panel borders assembly allow the wall panels to be centered over the grid lines while being completely supported from the foundation below in an embodiment of the present invention.

FIG. 73 shows how the floor panel borders assembly 134 allows the wall panels to be centered over the grid lines while being completely supported from the foundation below. Floor panel borders depicted in FIGS. 39, 40, and 41 can be constructed from but is not limited to the materials discussed above in reference to FIG. 53.

The identified individual components are manufactured in factory, flat packed, and shipped to the final building site where the individual components are assembled to the specified design configurations. The various utilities will be connected using standard building practices which allow for easy separation, such as but not limited to rubber couplings for plumbing. Utilities such as electricity can be scaled up or down through the addition of breakers and wiring into existing breaker boxes and utility channels. The various utility assemblies are accessible through removable panels in the walls, floors, and ceilings to increase the sustainability of the overall building system. After initial assembly, the individual components can be disassembled, relocated, reassembled into the same or an alternative configuration.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims. It will be understood by those skilled in the art that many changes in construction and widely differing embodiments and applications will suggest themselves without departing from the scope of the disclosed subject matter.

What is claimed is:

1. A method of modular construction, the method comprising the steps of:

(a) establishing a rectangular point grid, the rectangular point grid having a plurality of grid points connected by a plurality of grid lines;

(b) designing a floor plan for a structure based on the rectangular point grid, wherein the designing step further comprises:

(b1) laying out at least one interior wall between a first grid point and a second grid point along a grid line between the first grid point and the second grid point of the rectangular point grid;

(b2) laying out a rut wall panel column coincident with the first grid point;

(b3) laying out a second wall panel column coincident with the second grid point, wherein the at least one interior wall abuts against the rut wall column and abuts against the second wall column;

(b4) laying out at least one exterior wall between a third grid point and a fourth grid point along a grid line between the third grid point and the fourth grid point of the rectangular point grid;

(b5) laying out a third wall panel column coincident with the third grid point;

(b6) laying out a fourth wall panel column coincident with the fourth grid point, wherein the at least one exterior wall abuts against the third wall column and abuts against the fourth wall column;

(b7) designing a plurality of components with which to construct the structure that conforms to the rectangular point grid, wherein the plurality of components have dimensions that am integer multiples of a length of a one of the plurality of grid lines; and (b8) designing a plurality of floor panel border having a thickness equal to a floor panel thickness and a width equal to one half of a wall panel thickness wherein each of the plurality of floor panel borders have a different length such that an end of each of the plurality of floor panel borders when installed are coincident with a grid point or a midpoint of a grid line.

2. The method of modular construction according to claim 1 wherein the rectangular point grid is a 1×1×1 repeatable grid along an x-y-z-axis.

3. The method of modular construction according to claim 1 wherein a plurality of grid lines along the x axis of the rectangular point grid and a plurality of grid lines along the y axis of the rectangular point grid are of a same length.

4. The method of modular construction according to claim 1 wherein a plurality of grid lines along the x axis of the rectangular point grid have a first length, and a plurality of grid lines along the y axis of the rectangular point grid have a second length that is different from the first length.

5. The method of modular construction according to claim 1 wherein designing step (b7) further comprises the steps of:

designing a square floor panel and a rectangular floor panel wherein each side of the square floor panel and each side of the rectangular floor panel have a length that is an integer multiple of a length of a one of the plurality of grid lines; and a designing the square floor panel and the rectangular floor panel to have a predetermined thickness.

6. The method of modular construction according to claim 1 wherein designing step (b7) further comprises the steps of:

designing a solid wall panel wherein a width of the solid wall panel is an integer multiple of a length of a one of the plurality of grid lines less a thickness of the solid wall panel;

designing the solid wall panel to have a predetermined height and a predetermined thickness; and designing the solid wall panel to accommodate an embedded utility selected from the group a consisting of:

water supply lines;
wastewater return lines;
electrical lines;
cable tv lines;
security lines;
gas lines;
oil lines;
fire suppression lines;
climate controls; and
home security.

7. The method of modular construction according to claim 1 wherein designing step (b7) further comprises the steps of:

designing a wall panel window wherein a width of the wall panel window is an integer multiple of a length of a one of the plurality of grid lines less a thickness of the wall panel window, designing the wall panel window to have a predetermined height; and designing the wall panel window to have an opening to accept a style of window, the opening a having a shape to accommodate the style of window.

8. The method of modular construction according to claim 1 wherein designing step (b7) further comprises the steps of:

designing a wall panel large window wherein a width of the wall panel large window is an integer multiple of a length of a one of the plurality of grid lines less a half thickness of the wall panel large window;

designing the wall panel large window to have a predetermined height; and designing the wall panel large window to have an opening along one side to accept a large style of window, the opening having a shape to accommodate the style of window, wherein a first and second wall panel large window mate together to form a space to accommodate the large style of window.

9. The method of modular construction according to claim 1 wherein designing step (b7) further comprises the steps of:

designing a wall panel door wherein a width of the wall panel door is an integer multiple of a length of a one of the plurality of grid lines less a thickness of the wall panel door;

designing the wall panel door to have a predetermined height; and designing the wall panel door to have an opening to accept a style of door, the opening having a a shape to accommodate the style of door.

10. The method of modular construction according to claim 1 wherein designing step (b7) further comprises the steps of:

designing a wall panel wide door wherein a width of the wall panel wide door is an integer multiple of a length of a one of the plurality of grid lines less a half thickness of the wall panel wide door;

designing the wall panel wide door to have a predetermined height; and designing the wall panel wide door to have an opening along one side to accept a large style of a door, the opening having a shape to accommodate the style of door, wherein a first and second wall panel wide door mate together to form a space to accommodate the large style of door.

11. The method of modular construction according to claim 1 wherein designing step (b7) further comprises the steps of:

designing the wall panel columns to have a square cross section with a width equal to a thickness of a wall panel; and designing the wall panel columns to have a height equal to a height of the wall panel, wherein the wall panel columns can connect one, two, three, or four of the wall panels together.

12. The method of modular construction according to claim 1 wherein designing step (b7) further comprises the steps of:

designing a square ceiling panel and a rectangular ceiling panel wherein each side of the square ceiling panel and each side of the rectangular ceiling panel have a length that is an integer multiple of a length of a one of the plurality of grid lines; and designing the square ceiling panel and the rectangular ceiling panel to have a predetermined thickness.

13. The method of modular construction according to claim 1 wherein designing step (b7) further comprises the steps of:

designing a plurality of rectangular roof panels having a predetermined thickness; and designing the plurality of rectangular roof panels to have a width equal to an integer multiple of a length of a one of the plurality of grid lines, and a length slightly wider than an integer multiple of a length a one of the plurality of grid lines to accommodate for a slope of a roof.

14. A method of modular construction, the method comprising the steps of:

(a) establishing a rectangular point grid, the rectangular point grid having a plurality of grid points connected by a plurality of grid lines;

(b) designing a floor Plan for a structure based on the rectangular point grid, wherein the designing step further comprises:

(b1) laying out cat least one interior wall between a first grid point and a second grid point along a grid line between the first grid point and the second grid point of the rectangular point grid;

(b2) laving out a first wall panel column coincident with the first grid point;

(b3) laying out a second wall panel column coincident with the second rid point, wherein the at least one interior wall abuts against the first wall column and abut against the second wall column;

(b4) laying out at least one exterior wall between a third grid point and a fourth grid point along a grid line between the third grid point and the fourth grid point t) the rectangular point grid;

(b5) laying out a third wall panel column coincident with the third grid point;

(b6) laying out a fourth wall panel column coincident with the fourth grid point, wherein the at least one exterior wall abuts against the third wall column and abuts against the fourth wall column;

(b7) designing a plurality of components with which to construct the structure that conforms to the rectangular point grid, wherein the plurality of components have dimensions that an integer multiples of a length of a one of the plurality of rid lines; and (b8) designing a plurality of ceiling panel borders having a thickness equal to a ceiling panel thickness and a width equal to one half of a wall panel thickness, wherein each of the plurality of ceiling panel borders have a different length such that an end of each of the plurality of ceiling panel borders when installed are coincident with a grid point or a midpoint of a grid line.

15. A method of modular construction, the method comprising the steps of:

(a) establishing a rectangular point grid, the rectangular point grid having a plurality of grid points connected by a plurality of grid lines;

(b) designing a floor plan for a structure based on the rectangular point grid, wherein the designing step further comprises:

(b1) laying out at least one interior wall between a first grid point and a second grid point along a grid line between the first grid point and the second grid point of the rectangular point grid;

(b2) laying out a first wall panel column coincident with the first grid point;

(b3) laying out a second wall panel column coincident with the second grid point, wherein the at least one interior wall abut, against the first wall column and abuts against the second wall column;

(b4) laying out at least one exterior wall between a third grid point and a fourth grid point along a grid line between the third grid point and the fourth grid point of the rectangular point grid;

(b5) laying out a third wall panel column coincident with the third grid point;

(b6) laying out a fourth wall panel column coincident with the fourth grid point, wherein the at least one exterior wall abuts against the third wall column and abuts against the fourth wall column;

(b7) designing a plurality of component, with which to construct the structure that conforms to the rectangular point grid, wherein the plurality of components have dimensions that are integer multiples of a length of a one of the plurality of grid lines; and (b8) designing an attic end triangle base having a thickness equal to a wall panel thickness, a base having a length equal to an integer multiple of a length of a one of the plurality of grid lines plus one half of the wall panel thickness, and a height such that a slope of the attic end triangle base matches a slope of a roof defined by a rise and run.

16. The method of modular construction according to claim 1 wherein designing step (b7) further comprises the steps of:

designing an attic end rectangle base having a thickness equal to a wall panel thickness, a length equal to an integer multiple of a length of a one of the plurality of grid lines, and a height equal to a height of an attic end triangle base.

17. The method of modular construction according to claim 1 wherein designing step (b7) further comprises the steps of:

designing an attic end triangle having a thickness equal to a wall panel thickness, a length equal to an integer multiple of a length of a one of the plurality of grid lines, and a height such that a slope of the attic end triangle matches a slope of a roof defined by a rise and run.

18. The method of modular construction according to claim 1 wherein designing step (b7) further comprises the steps of:

designing an attic end rectangle having a thickness equal to a wall panel thickness, a length equal to an integer multiple of a length of a one of the plurality of grid lines, and a height equal to a height of an attic end triangle.

* * * * *